US006019228A

United States Patent [19]

Duggan

[11] Patent Number: 6,019,228

[45] Date of Patent: Feb. 1, 2000

[54] VIBRATING SCREEN DECK SUPPORT FRAMEWORK SYSTEM

[76] Inventor: John C. Duggan, 5995 Dover Rd., Lakeview, N.Y. 14085

[21] Appl. No.: 09/001,597

[22] Filed: Dec. 31, 1997

[51] Int. Cl.[7] ..... B07B 1/49

[52] U.S. Cl. ..... 209/408; 209/412; 209/352; 209/409; 209/281

[58] Field of Search ..... 209/405, 408, 209/409, 412, 352, 281

[56] References Cited

U.S. PATENT DOCUMENTS

| | | | |
|---|---|---|---|
| 607,598 | 7/1898 | Closz | 209/405 |
| 696,189 | 3/1902 | Pillmore | 209/403 |
| 2,190,993 | 2/1940 | Muir | 209/405 |
| 2,314,879 | 3/1943 | Heller | 209/408 |
| 3,565,251 | 2/1971 | Pennington | 209/405 |
| 3,795,311 | 3/1974 | Martin | 209/405 |
| 4,040,951 | 8/1977 | Cole | 209/408 |
| 4,137,157 | 1/1979 | Deister et al. | 209/405 |
| 4,265,742 | 5/1981 | Bucker et al. | 209/281 |
| 4,840,728 | 6/1989 | Connolley et al. | 209/409 |
| 5,248,043 | 9/1993 | Dorn | 209/412 |

*Primary Examiner*—Donald P. Walsh
*Assistant Examiner*—Joe Dillon, Jr.

[57] ABSTRACT

A modular deck support framework system employing support tray framework sections for vibrating screens having an essentially rectangular outlined perimeter framework. Each support tray perimeter framework has at least: two opposed side framework members and a square cut cross-angle 50, or notched end angle 62, as a feed end cross framework member; and a square cut flat stock 52 or curved top flat stock 52C as a discharge end cross framework member. Square cut cross-angle 50 is oriented such that square cut cross-angle upper leg 50U is pointing essentially upwards and essentially perpendicular to the flow of particles over support trays, and square cut cross angle lower leg 50L is pointing essentially with the flow of particles over support trays. Notched end angle 62 is oriented similarly whenever employed. Square cut flat stock 52 is oriented such that square cut flat stock short side 52S is essentially parallel with the flow of particles being sorted and square cut flat stock long side 52L is essentially perpendicular with the same flow. Curved top flat stock 52C is oriented similarly whenever employed. Support trays also contain wide seal strip support bar 44, or one or more seal strip supports 30, adjacent to and/or above feed end cross framework members, and/or adjacent to and/or above discharge end cross framework members at seam areas of support tray frameworks for increased strength and/or protection and/or to support screening media edges. Typically fastener holes are present to attach modular support trays to vibrating screen side-walls and to each other as needed.

9 Claims, 16 Drawing Sheets

VIBRATING SCREEN DECK SUPPORT FRAMEWORK SYSTEM

BACKGROUND—FIELD OF INVENTION

This invention relates to vibrating screen decks, specifically to deck support framework structures and to deck support tray frameworks.

BACKGROUND—CROSS REFERENCES TO RELATED APPLICATIONS

This invention can be used in combination with my co-pending application, Ser. No. 08/876,621 filed Jun. 14, 1997.

BACKGROUND—DISCUSSION OF PRIOR ART

Vibrating screens are used to sort particles and other materials commonly known as aggregates. This sizing is accomplished by causing materials to be sorted to vibrate over some type of porous planar surface. Aggregate particles that fall through openings in a porous surface are of one size and particles that do not fall through, but pass over these same openings are of another size.

Vibrating screens employ gravity in part to accomplish their sorting/sizing. This determines the orientation of the porous planar surfaces over which aggregates flow. The orientation of porous planar surfaces is such that surfaces with larger openings are higher in vibrating screens. This orientation is accomplished in layers called decks. Decks are typically composed of some type of porous planar sheets, such as wire cloth, with a supporting framework underneath. Decks that are higher in a vibrating screen have larger openings or pores than lower decks. An example of this is a machine with two decks, one of 4-inch openings and another of 2-inch openings. When a particle of 3 inches is vibrated over the top deck it will fall through a 4-inch opening to the bottom deck, but pass over the deck having 2-inch openings and exit the machine. Thus particles are sized by the sequence of decks that they fall through, or fail to fall through.

Two basic different types of deck support frameworks are used in vibrating screens: single-piece and multiple-pieced. Single-piece frameworks are essentially continuous with structural members being permanently joined together forming one large framework. Multiple-pieced frameworks are discontinuous or modular, each deck comprising several individual frameworks. Single-piece frameworks are often joined to vibrating screens by a permanent mechanical fastening means. Multiple-pieced frameworks are often fastened with easily removable fasteners. Multiple-pieced frameworks are defined by the Vibrating Screen Manufacturer's Association as "support trays", also sometimes called panel frames. Both single-piece and multiple-pieced support frameworks have their advantages and their disadvantages.

A third, less common, type of vibrating screen deck support framework structure is a combination of both single-piece and multiple-pieced designs. A typical combination design comprises a series of support trays having long, thin, continuous structural members attached on top. Typically the long, thin structural members rest upon and are welded to support trays and support whatever screening media is employed.

Each of the two basic types of vibrating screen deck support framework structures has its advantages:

Single-piece frameworks typically have fewer cross support members, require less cutting of support bars, typically require fewer fasteners for assembly and in general can be less costly to manufacture.

Multiple-pieced frameworks (support trays) are in some regards easier to control during manufacturing due to the smaller size of components and are easily replaced (individually) for the end user.

The disadvantages of the two basic types of screen deck support framework structures are generally the inverse of the above:

Single-piece frameworks are more difficult to control during manufacture and also are quite difficult (or not reasonably possible) to replace once in service and thus require field fabrication repairs.

Multiple-pieced frameworks typically have: a) more cross support members-as adjacent pieces comprise seams between support trays; b) more cuts for support bars-which begin and end at seams between support trays; c) more fasteners typically—to join adjacent members at seams between support trays.

Both types of vibrating screen deck support framework structures are currently manufactured with widespread success, though single-pieced systems seem more prevalent. Single-piece deck framework systems are generally "manufacturer friendly" whereas support trays are generally "user friendly".

The need for support trays as a deck support framework in vibrating screens is seemingly customer driven. It is much easier to replace support trays individually or in groups than to replace parts of, or entire, single-piece frameworks. Typically decks of the single-piece designs are permanently fastened to vibrating screen side-walls. Typically decks of the single-piece designs are thus repaired with metal fabrication equipment on site. This is costly and can be dangerous. However, support trays are more costly to manufacture. There is thus a need to manufacture more cost effective support trays. If, in addition, support trays can simultaneously be made to perform more efficiently, this also would be very desirable.

My present invention concerns an improved support tray design as part of a modular vibrating screen deck support framework system.

Current support tray designs are typically comprised of a perimeter framework having mitered corners much like a picture frame. Typically these perimeter frameworks are made up of channel or angle with their legs pointing inward and these legs are mitered at the corner joints. It is this perimeter framework of support trays that my improved support tray design is mostly concerned with and improves upon.

Some of the particular problems with existing support tray designs in the prior art for both angle and channel type support tray frameworks are:

a) Prior art support tray inward pointing channel and angle legs facing aggregate flow erode in critical stress areas.

b) Prior art support trays resist aggregate flow at seams between support trays by end framework cross-angles and cross channels.

c) Prior art support trays require miter cutting of inward facing angle and channel legs, 8 and 16 cuts per support tray, respectively.

d) Prior art support trays having an angular perimeter framework form a weaker structural element at the joint between adjacent support trays.

e) Prior art support trays employ butt-welded joints at miter cuts in corners which require grinding to maintain the outside flat planar surfaces.

f) Prior art support trays require notches or cut outs at both ends of each support bar used to fit around channel and angle legs.

OBJECTS AND ADVANTAGES

Accordingly, several objects and advantages of my invention are:

a) to provide a support tray with improved wear characteristics that is less vulnerable to abrasive particles in critical stress areas;

b) to provide a support tray with improved aggregate flow characteristics;

c) to provide a support tray requiring no miter cuts or fewer miter cuts for framework corner manufacture;

d) to provide a support tray with improved strength and/or weight characteristics;

e) to provide a support tray that requires less grinding and/or less welding than conventional mitered framework corner manufacture; and f) to provide a support tray that eliminates or reduces the manufacturing requirement for support bar end cutouts.

Further objects and advantages are to provide a support tray unit as part of a multiple-pieced interconnected framework assembly for vibrating screen decks, easier to manufacture than current designs and more efficient to operate. Still further objects and advantages will become apparent from a consideration of the ensuing description and drawings.

DRAWING FIGURES

In the drawings, closely related figures have the same number but different alphabetic suffixes. Typically the structures shown are of a metal composition but are not limited strictly to metals but can also be manufactured of a variety of available structurally capable materials. The "FLOW" vector shown in all figures represents the typical, general direction of aggregate flowing over a vibrating screen deck. Welds/bonding agents for components are not shown in the drawing figures.

FIGS. 9, 10, 11, and 12 each show an oblique view of an individual support tray of the present support tray invention.

Figure 13:
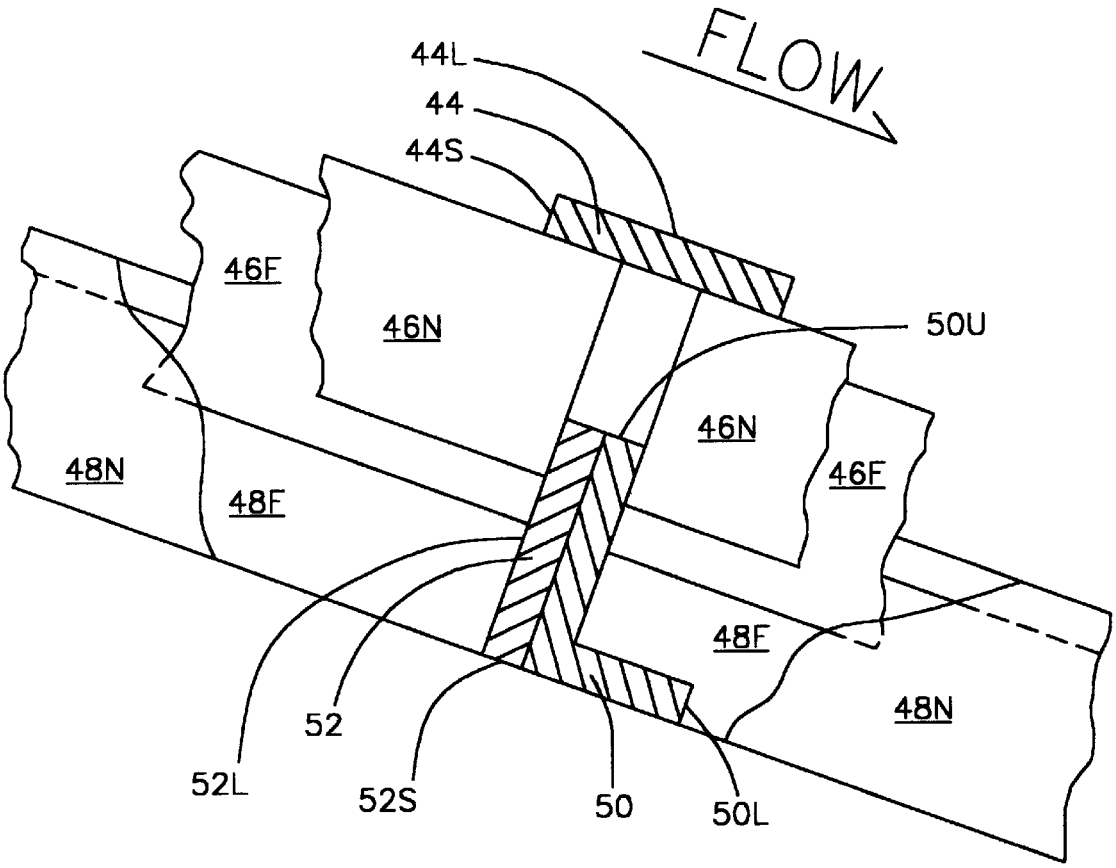
Figure 14:
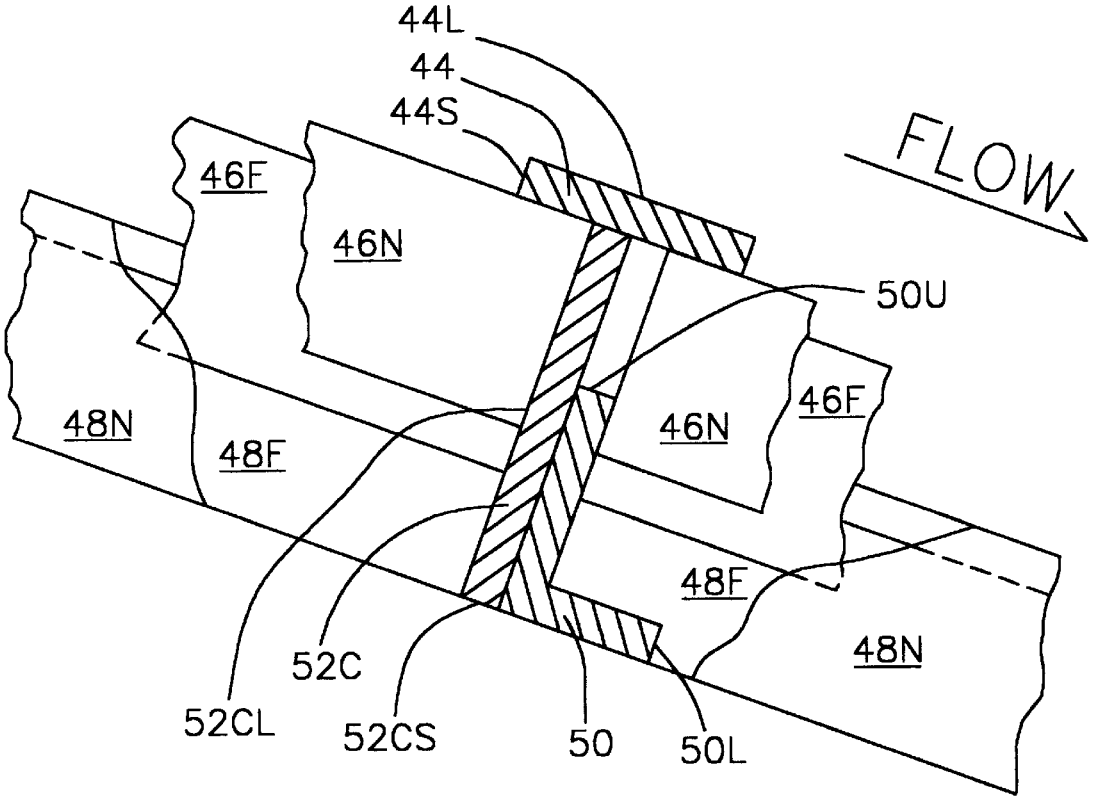

FIGS. 13 and 14 show partial side views of two sets of adjacent improved support trays, shown in an installed position and joined.

REFERENCE NUMERALS IN DRAWINGS

20—end mitered side channel
20N—near end mitered side channel
20F—far end mitered side channel
22—aggregate particles
24—end mitered cross channels
24U—upstream end mitered cross channels
24D—downstream end mitered cross channels
26—wire cloth
28—seal strip
30—seal strip support
30S—seal strip support short side
30L—seal strip support long side
32—end notched support bar
32N—near end notched support bar
32F—far end notched support bar
34—support bar rubber cap
36—fastener hole
38—end mitered side angle
38N—near end mitered side angle
38F—far end mitered side angle
40—end mitered cross-angle
40U—upstream facing end mitered cross-angle
40D—downstream facing end mitered cross-angle
42—cross-angle support
44—wide seal strip support bar
44S—wide seal strip support bar short side
44L—wide seal strip support bar long side
46—plain end support bar
46N—near plain end support bar
46F—far plain end support bar
48—square cut side angle
48N—near square cut side angle
48F—far square cut side angle
50—square cut cross-angle
50U—square cut cross-angle upper leg

Figure 1:
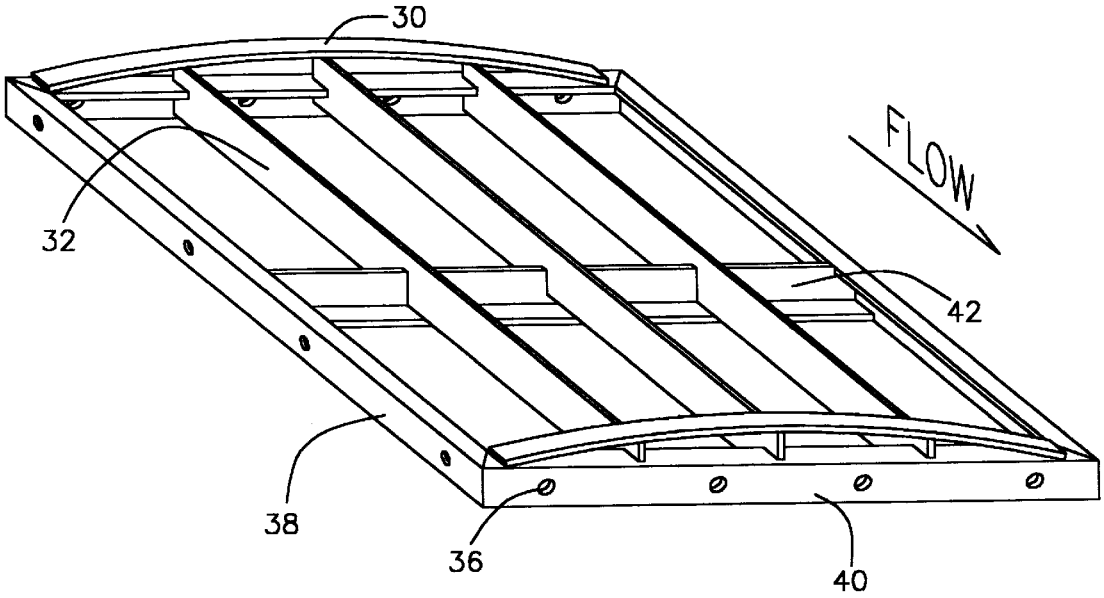
FIG. 1 PRIOR ART
FIG. 1 is PRIOR ART and shows an oblique view of a typical prior art support tray having a perimeter framework of angle.

50L—square cut cross-angle lower leg
52—square cut flat stock
52S—square cut flat stock short side
52L—square cut flat stock long side
52C—curved top flat stock
52CS—curved top flat stock short side
52CL—curved top flat stock long side
54—supporting gusset
60—square cut side channel
62—notched end angle
62U—notched end angle upper leg
62L—notched end angle lower leg
64—cross tube support
66—end plate
68—end plate side
70—support stub FIG. 1—Prior Art—Description of Angle Type Support Tray/Operation of Angle Type Support Tray Description of Prior Art Angle Type Support Tray (FIG. 1)

FIG. 1 is prior art. A typical prior art vibrating screen deck support tray is shown in FIG. 1. Shown is an oblique view of a typical prior art support tray framework having a perimeter framework of angle. This type of support tray provides support for wire cloth, though none is shown in FIG. 1. The "FLOW" vector shown in FIG. 1 indicates the general flow of aggregate over the surface of support trays and wire cloth (when installed).

Support trays shown in FIG. 1 are typically made of metal joined together by welding. Typically support tray members are welded at joints where members contact each other. The perimeter framework comprises two end mitered side angles 38 and two end mitered cross-angles 40. Both end mitered side angles 38 and end mitered cross-angles 40 are cut to length, then miter cut and have material removed for fastener holes 36. This perimeter framework is similar to picture frames with mitered corners, with angle legs directed inward to the center of the framework. Thus typical prior art support tray perimeter frameworks are symmetrical about two axes. Typically cross-angle supports 42 establish the direction of installation and flow of aggregate/product to be sorted.

Cross-angle supports 42 are oriented between and are perpendicularly joined to end mitered side angles 38 and are between and parallel to end mitered cross-angles 40. Mitered side angles shown in FIG. 1 have fastener holes 36 to mount the support tray to vibrating screen side-walls. Mitered cross-angles 40 have fastener holes 36 to join support trays to each other and to mount support trays to vibrating screen deck back plate, feed box, discharge lip or other deck end component. End notched support bars 32 are oriented between and parallel to end mitered side angles 38. End notched support bars 32 are also located between and perpendicular to end mitered cross-angles 40. End notched support bars 32 have angle leg notch outs at both ends where they mesh with and are joined to end mitered cross-angles 40. End notched support bars 32 also have angle leg notch outs where they mesh with and are joined to the legs of cross-angle supports 42. End notched support bars 32 have support bar rubber caps (not shown in FIG. 1) capping top edge between wire cloth and end notched support bar 32.

Support bar rubber caps are typically "C" shaped in cross section and clip over top of end notched support bar 32 with a friction fit. Support bar rubber caps are shown in prior art FIGS. 2, 3 and 4. Seal strip supports 30 are centered between and relatively perpendicular to end mitered side angles 38 in an arcuate manner above end mitered cross-angles 40. Seal strip supports 30 contact and are joined to the top side of each of the various end notched support bars 32 thereby forming an arc. Seal strip supports 30 terminate at and join end mitered cross-angles 40 near support tray corners. Sometimes in the prior art additional support gussets are added underneath seal strip supports 30 between end notched support bars 32. No such support gussets are shown in FIG. 1. These support gussets are needed due to the spacing of end notched support bars 32 as well as the thickness of seal strip supports 30—typically ¼ in. or 5/16 in. thick.

Figure 2:
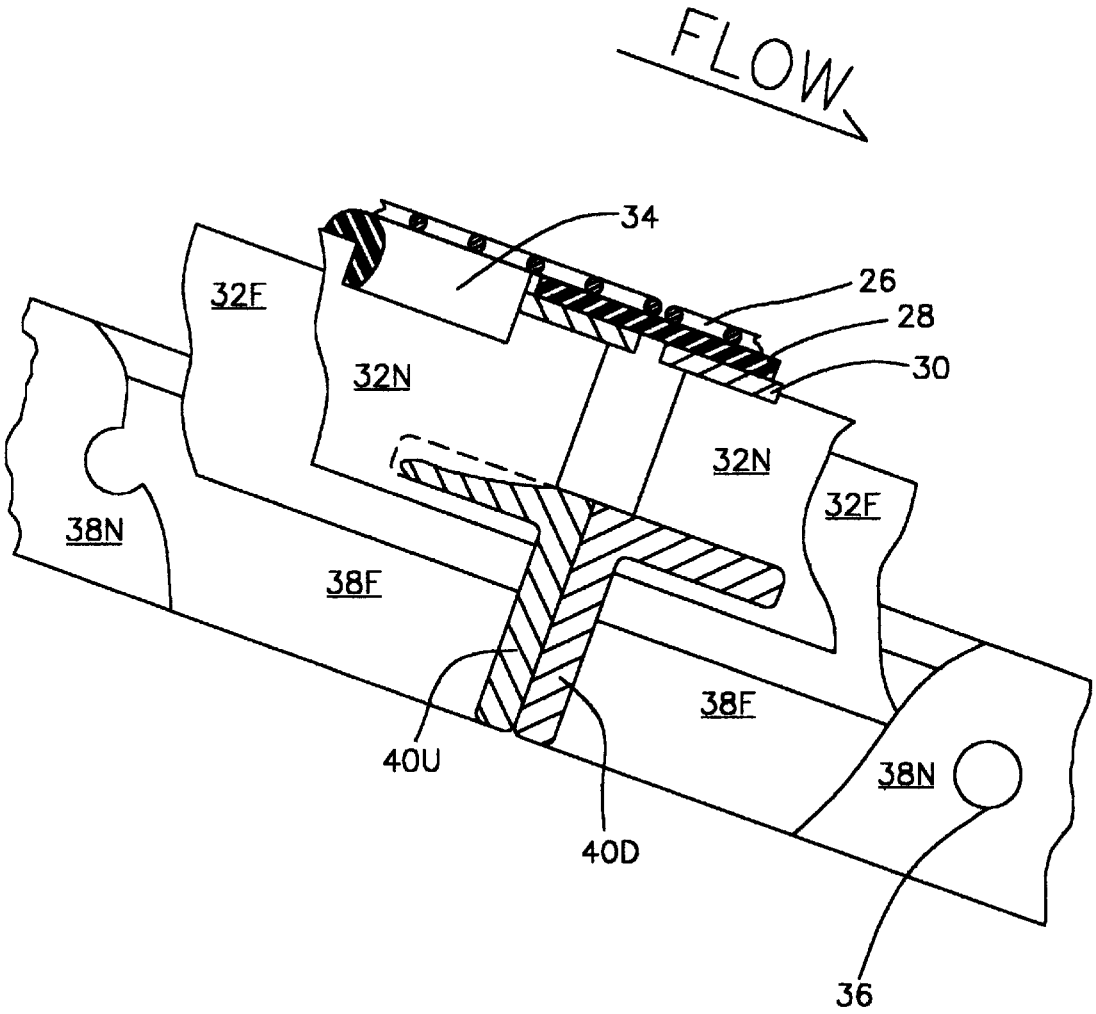
FIG. 2 PRIOR ART
FIG. 2 is PRIOR ART and shows a partial side view of two adjacent support trays having a perimeter framework of angle shown in an installed position and joined, with the joint/seam area shown in broken section.
Figure 4:
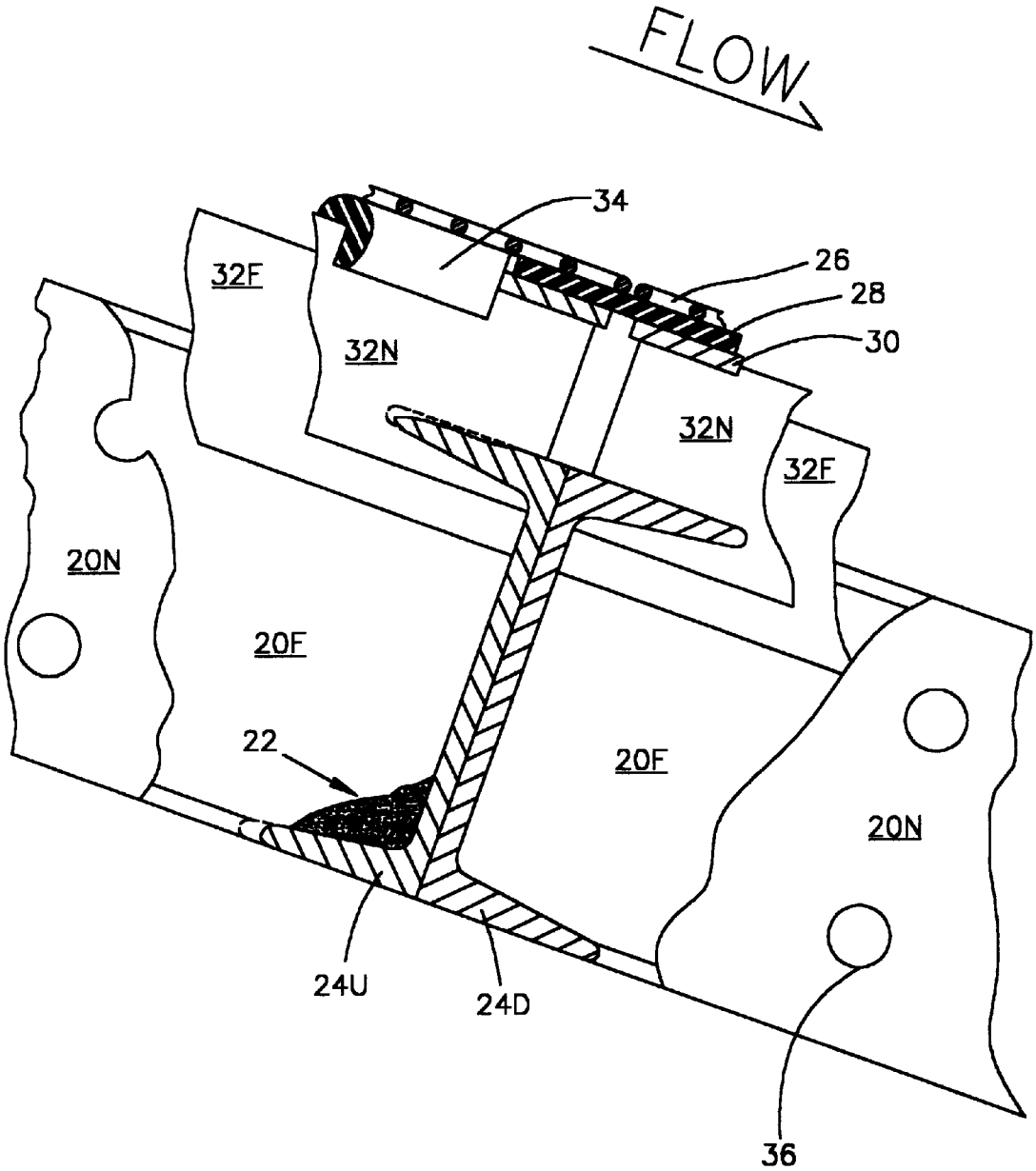
FIG. 4 PRIOR ART
FIG. 4 is PRIOR ART and shows a partial side view of two adjacent support trays having a perimeter framework of channel shown in an installed position and joined, with the joint/seam area shown in broken section.

Seal strips are typically made of rubber and cover over, and are attached to, the top surface of seal strip support 30 by adhesive. No seal strips are shown in FIG. 1, but these are illustrated in FIGS. 2 and 4. Wire cloth (not shown in FIG. 1) typically covers over and contacts both seal strip 28 and support bar rubber caps (not shown in FIG. 1) as well. This isolates wire cloth (not shown in FIG. 1) from support trays such as shown in FIG. 1. This isolation protects from undesirable rubbing of wire cloth on support trays and aids in maintaining the tension applied to wire cloth. Seal strips and seal strip supports 30 in the prior art provide support for wire cloth edges at seams between support trays. This is to "match up" edges of adjacent sections of wire cloth preventing leakage of aggregate. Typical also is the absence of seal strips and seal strip supports 30 for support trays used with very rigid and coarse wire cloth, as it is not needed.

Operation of Prior Art Angle Type Support Tray (FIG. 1)

The view shown in FIG. 1 is a typical orientation for prior art support trays installed in an inclined vibrating screen. In this typical embodiment the feed end of the vibrating screen is higher in elevation than the discharge end. The motion of an inclined vibrating screen is typically a circular orbit, the axis of which is essentially parallel to cross-angle supports 42. This same support tray structure is employed in horizontal (also known as "flat") vibrating screens. In horizontal vibrating screen applications the decks are essentially not inclined (a deck's feed end is essentially level with its discharge end) and the vibrating motion is different from an inclined vibrating screen. The motion of horizontal vibrating screens is elliptical or oval in shape. This accelerates aggregate particles upward and forward simultaneously. Again the axis of orbit is essentially parallel to cross-angle supports 42. In either case the motion is essentially a parabolic trajectory above and through the wire cloth for particles being sorted. It should be further noted that all parts shown in FIG. 1 are essentially static relative to each other and typically move in unison together with the vibrating screen body.

The typical installation of prior art support trays such as the one shown in FIG. 1 is similar for both inclined and horizontal vibrating screens. The operational objectives and duties of the support tray in either application are essentially the same whether the working surface of the support tray is inclined to the horizon or not. In both cases the vibrating screen support trays are joined end to end with their end mitered side angles 38 attached to the side-walls of a vibrating screen body. The deck surface of an inclined vibrating screen is forced in a circular oscillation with gravitational force assisting the forward conveyance of aggregate particles downward over the sloped wire cloth. The deck surface of a horizontal screen is essentially not inclined but employs an elliptical oscillation that accelerates aggregate particles simultaneously upward and forward toward the discharge end of the vibrating screen.

One main function of a typical support tray as shown in FIG. 1 is to provide support for wire cloth or some other porous screening media covering the support tray. Loading of support tray components shown in FIG. 1 comes from gravity acting on, and the inertia of, support tray components in motion themselves as well as the impact loading of aggregate particles being sorted. Support trays such as that shown in FIG. 1 also carry other loads as they provide rigidity for, and help locate, vibrating screen side-walls. As aggregate particles are sorted they are supported by wire cloth which is basically supported by end notched support bars 32 which are basically supported by cross-angle supports 42 and end mitered cross-angles 40. Cross-angle supports 42 and end mitered cross-angles 40 basically transfer their loads to end mitered side angles 38 which are supported by vibrating screen side-walls.

In FIG. 1 both cross-angle supports 42 and end mitered cross-angles 40 are oriented essentially crosswise (i.e. normal) to the flow of aggregate particles. Mitered cross-angles 40 are of particular interest, in that end framework members are always used, whereas cross-angle supports 42 are sometimes used. Sometimes other structural shapes are used for internal support or no internal support member is used. Also end mitered cross-angles 40 are more critical as a support element of the support trays in question and must be contrasted here in the prior art with my improved support tray system.

Mitered cross-angles 40 in general are essentially long slender structural members, which are transversely loaded quite similar to a simple beam problem in classical mechanics. In such a problem both beam-ends are supported and a downward load is imposed between the supported ends. This is similar to the situation with end mitered cross-angles 40. In this type of situation the minor stresses are the shear stresses which are located at or near the ends of the long slender members transversely loaded. Mitered cross-angles 40 are subjected to a principal major stress, namely the bending moment, due to their orientation in the vibrating screen.

The major stresses are the bending moment stresses, which are located at or near the center of the long slender members transversely loaded. This is true for loads, which are uniform and centered. Essentially this is also the loading for end mitered cross-angles 40 as part of a support tray framework in the prior art. Wire cloth is loaded in the operation of a vibrating screen with an essentially uniform layer of aggregate/product. This load is carried at the seams between support trays in the prior art by end mitered cross-angles 40. Adjacent support trays have two end mitered cross-angles which are opposed and joined at each seam between adjacent support trays. Thus the center area of end mitered cross-angles 40 located at or near the midpoint between side-walls of a vibrating screen is critical regarding stress. This area is of particular concern due to the present conditions in the prior art regarding wear due to abrasion from aggregate particles. Additionally, resistance to the flow of aggregate/product is undesirable in prior art designs. FIG. 2 shows this seam area in a partial side view with a broken away section revealing the center area of two adjacent end mitered cross-angles 40.

FIG. 2—Prior Art—Description of Side View of Two Adjacent Angle Type Support Trays/Operation of Side View of Two Adjacent Angle Type Support Trays Description of Side View of Two Adjacent Prior Art Angle Type Support Trays (FIG. 2)

FIG. 2 is prior art. FIG. 2 is a partial side view showing the seam area between two adjacent prior art support trays. The support trays shown in FIG. 2 have a perimeter framework of angle and are essentially identical to the prior art support tray shown in FIG. 1. The support trays shown in FIG. 2 are shown positioned as if installed in an inclined vibrating screen. Vibrating screen side-walls are not shown in FIG. 2, just two support trays covered with wire cloth 26. The area adjacent to the seam between support trays is shown in broken away section to better illustrate the critical center area midway between sides of the support trays. The "FLOW" vector shown in FIG. 2 indicates the general flow of aggregate over the surface of support trays and wire cloth.

Both support trays are shown to be essentially symmetric to each other about the seam between support trays. End mitered cross-angles 40U and 40D establish the seam between adjacent support trays. Seal strip 28 is shown to span the seam between support trays and is attached to both seal strip supports 30. Upstream facing end mitered cross-angle 40U has an angle leg that faces aggregate flow. Aggregate particles are not shown in FIG. 2 but are shown to have worn away the leg area of cross-angle 40U. The original profile of cross-angle 40U can be seen in the dotted outline. Downstream facing end mitered cross-angle 40D is fastened to cross-angle 40U, but has a downstream facing angle leg. Both end mitered cross-angles 40U and 40D are the uttermost member of the support tray in each case.

End mitered side angles 38N and 38F can be seen flanking end mitered cross-angles 40U and 40D in FIG. 2. Near end mitered side angle 38N is closer to the observer of FIG. 2, far end mitered side angle 38F is further away. Near side angles 38N are shown broken away to reveal the inner portions of the support tray at the center of the span between side-walls. The perimeter framework of these prior art support trays requires miter cuts at all corners for proper fitting of all members. Thus for one support tray each perimeter angle (4 are required) requires 2 miter cuts. Each support tray of an angle type needs eight 45-degree miter cuts. With multiple decks, such as 3 or 4, and with 4 or 5 support trays per deck this adds up. There are smaller machines that require fewer support trays, but there are also larger machines as well. The size of machines has tended to grow in recent years.

End notched support bars 32N and 32F are also shown in FIG. 2. Both end notched support bars 32N and 32F are shown broken away to better reveal far mitered side angles 38F. Fastener holes 36 are shown in near side angles 38N, but are not illustrated in far side angles 38F. Both ends of near end notched support bar 32N and far end notched support bar 32F are notched out. This notch out is to give "relief" for the angle legs of cross-angles 40D and 40D. A support tray typically has at least 3 but as many as 9 (or perhaps more) support bars. Perhaps an average would be 5-this would require 10 cuts per support tray. With perhaps 12 as an average number of support trays per machine—this would be 120 notch outs per machine.

Operation of Side View of Two Adjacent Prior Art Angle Type Support Trays (FIG. 2)

FIG. 2 shows a composite beam at midpoint in cross section formed by the joining of two opposed support tray end mitered cross-angles 40U and 40D. This composite beam element shown in cross section is undergoing typical compressive and tensile forces imposed by an induced bending moment. It should be noted that no force vectors or lines of stress are shown in FIG. 2. It should be also noted that this description of operation will start with end mitered cross-angles 40 alone without any contributing effects from seal strip supports 30. End mitered cross-angles 40 are symmetric about seams between two adjacent support trays with: 1) both angle "heels" together; 2) two adjacent angle "legs" both pointed downward (forming the support tray seam); and 3) remaining two angle legs horizontally opposed—one pointing upstream—against aggregate flow, one pointing downstream-with aggregate flow. This essentially forms a composite beam "T" shaped in cross section. Such a beam design is not a good design to resist the bending moment—which typically is the greatest stress imposed on these joined members. Maximum stresses are present at fibers furthest from the neutral axis due to the bending moment.

For such reasons the "I" beam has been created and used—having upper and lower fiber "slab" areas. In general beams that have the furthest distance between fiber "slabs" have the greatest strength to resist the bending moment—all other things being equal. Numerically this distance is important because small changes have a significant effect on performance of the beam. In the "I" beam case the neutral axis is essentially located equidistant between the top and bottom fiber "slabs" which are equal in cross sectional area. This balances the compressive and tensile forces that these outermost fibers are subjected to during transverse loading. In the case of the joined angle composite beam forming the seam between support trays, the largest "fiber slab areas" are located at the top of the "T", one on the left and one on the right-leaving little area on the bottom. Thus there is an imbalance in areas between upper and lower halves of the cross sectional area shown in FIG. 1.

This imbalance causes the neutral axis to be located closer to the top of the "T" near the larger fiber slabs. The upper (more horizontally oriented angle leg) portions of this "T" are in compression. The lower (more vertically oriented angle leg) portions of the "T" are in tension. The upper half of the "T" composite beam has significantly greater cross sectional area than the lower half When loaded, stresses cause the neutral axis to locate above the halfway point, closer to the upper fiber slabs. Thus the lower tensile areas need more than just the lower half of the "T" beam to be in balance with the compressive forces withstood by the top of the "T", which has much greater area at its upper extremes. Consequently this composite "T" beam is not an optimal employment of the materials used. Basically "equal areas of fiber/mass located equidistant from the neutral axis and connected as far apart as possible" is a good general design rule for a center area cross section of a beam subject to a bending moment.

As was seen in FIG. 1 both seal strip supports 30 are connected to end mitered cross-angles 40 through end notched support bars 32 and (when used) support gussets. This is partially shown in FIG. 2, with the joint area between support trays shown in broken section. Seal strip supports 30 are typically composed of the same material as cross-angles 40. As shown in FIG. 2 seal strip supports 30 are located above end mitered cross-angles 40. Thus it seems probable that seal strip supports 30 contribute to resist the imposed bending moment somewhat. However these uppermost fiber "slabs" (seal strip supports 30) are prevented from being significant contributors to the resistance for several reasons. The design objective of seal strip supports 30 has been expressly for the purpose of supporting seal strips 28 and thus wire cloth edges. Material for seal strip supports 30 is typically somewhat thinner than the angles to which it joins ¼ in. or 5/16 in. thick. Angles are most often thicker, ⅜ in. or ½ in. for the more common support tray sizes. Clearly it would be better to have thicker seal strip supports 30 if they were to be used in both capacities.

The most significant factor that prevents seal strip supports 30 from resisting the bending moment efficiently is their physical orientation above end mitered cross-angles 40. As can be seen in FIG. 2 seal strip supports 30 are located above the top fiber "slabs" of end mitered cross-angles 40 thus causing the neutral axis to be located even higher than in the simple "T" composite beam profile mentioned above. Thus the fiber slabs of greatest cross sectional area—namely the legs of the end mitered cross-angles 40—are brought even closer to the neutral axis (zero stress area) where they can do even less to resist the imposed bending moment. This change of the neutral axis location occurs in relation to the amount seal strip supports 30 contribute to resist the imposed bending moment. Seal strip supports 30 in the prior art have not been designed to resist the bending moment. Furthermore current seal strips 30 are not in a position to contribute desirable resistance to an imposed bending moment in the prior art. While I believe that it can be shown mathematically that the above statements are true, I do not wish to be bound by the above theories. I believe that employing calculus/applied mathematics to obtain the second moment of area of cross sections of prior art perimeter angle frame designs when compared with my improved support tray design, will show my design to be superior in strength.

Clearly current designs for support trays employing end mitered cross-angles 40 for end framework members with or without seat strip supports 30 are not optimal in operation with regard to imposed stresses. Further limitations are quite obvious when one considers the erosion of the composite beam. In particular the leading edge of the upstream pointing angle which is shown to be eroded in FIG. 2 in a manner typical with this prior art. The area subject to erosion is critical in resisting one of the greatest stresses imposed—the bending moment. The negative result is a weakening of a less than optimal design.

Figure 3:
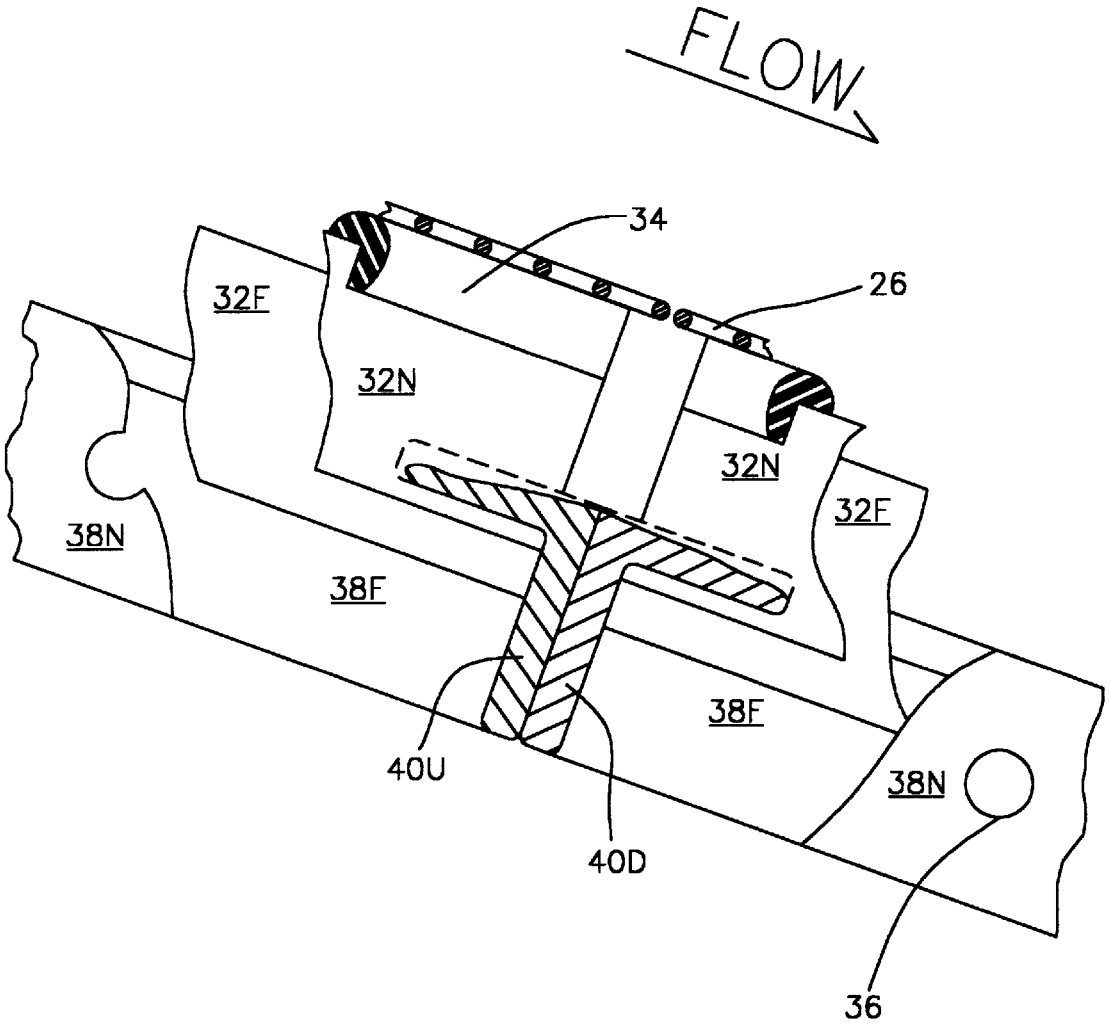
FIG. 3 PRIOR ART
FIG. 3 is PRIOR ART and shows a partial side view of two adjacent support trays having a perimeter framework of angle shown in an installed position and joined, with the joint/seam area shown in broken section.

FIG. 3—Prior Art—Description of Side View of Two Adjacent Angle Type Support Trays/Operation of Side View of Two Adjacent Angle Type Support Trays Description of a Side View of Two Prior Art Adjacent Angle Type Support Trays (FIG. 3)

FIG. 3 is prior art. The "FLOW" vector shown in FIG. 3 indicates the general flow of aggregate over the surface of support trays and wire cloth. Shown in FIG. 3 is a partial side view of a joint formed by two adjacent support trays similar to prior art FIG. 2. FIG. 3 is different in that two seal strip supports 30 and a seal strip 28 are not employed and a different wear pattern is contrasted by the original dotted profile. FIG. 3 is essentially the same structure as FIG. 2 except those items just mentioned. The deletion of these items is typically done in the prior art when larger aggregate particles are being sorted. Larger aggregate particles require heavier gauge wire cloth with larger openings. This heavier gauge wire cloth is stiffer and needs no support at seams between support trays; thus no seal strip supports 30 or seal strip 28 are used.

Operation of a Side View of Two Prior Art Adjacent Angle Type Support Trays (FIG. 3)

Shown in FIG. 3 is a prior art support tray similar to that shown in both FIGS. 1 and 2. FIG. 3 as described above is lacking both seal strip supports 30 and a seal strip 28. In such an application these items lacking are typically non-essential when "heavier gauge" wire cloth is used. "Heavy gauge" wire cloth has more rigid edges and as a consequence has little or no need for edge support. The operational principles and limitations of this prior art support tray design have been discussed in the first portion of "Operation" section of FIG. 2 above. In FIG. 3 the effect from both seal strip supports 30 is thus absent from the composite beam formed by both end mitered cross-angles 40. This is discussed in the text for FIG. 2 as a "T" shaped cross sectional area of the composite beam formed by two adjacent angle type support trays. As with FIG. 2 the "fiber slab" erosion shown which is typical of this prior art weakens the most critical area of the composite beam—compromising the strength and component life further. Such erosion is typically more significant due to the absence of the seal strip supports 30 and seal strip 28. Seal strip 28 and seal strip supports 30 would otherwise act as a shield over part of the composite beam formed by both end mitered cross-angles 40U and 40D. Typically the loads on these types of applications are greater than those imposed on support trays having lighter gauge wire cloth. It would then be reasonable to conclude that if seal strip supports 30 were a significant contributor to resisting stresses that they would be employed in heavier stress applications such as are shown in FIG. 3.

FIG. 4—Prior Art—Description of Side View of Two Adjacent Channel Type Support Trays/Operation of Side View of Two Adjacent Channel Type Support Trays Description of a Side view of Two Prior Art Adjacent Channel Type Support Trays (FIG. 4)

FIG. 4 is prior art. The "FLOW" vector shown in FIG. 4 indicates the general flow of aggregate over the surface of support trays and wire cloth. FIG. 4 is a partial side view of the seam area between two adjacent channel type support trays. In the view shown mitered end channels 24U and 24D, end mitered side channels 20N and 20F, end notched support bars 32N and 32F, rubber channel 34, seal strip supports 30 and wire cloth 26 are all typically symmetric about the seam between the two adjacent support trays shown. Upstream end mitered cross channel 24U and downstream end mitered cross channel 24D essentially form the seam between adjacent support trays. Spanning the seam between the two support trays shown is seal strip 28. The prior art support trays are shown in an installed position in an inclined vibrating screen. Both upper and lower portions of the legs of end mitered cross channel 24U pointing against the flow of aggregate particles are shown to be worn. This is a typical pattern of structure loss due to abrasion—the dotted lines indicate original material profile.

The application for support trays of this type in the prior art is typically for larger vibrating screens. Typically these larger machines are wider and often have longer deck lengths/more support trays. This design is somewhat similar to angle type support trays shown previously in FIGS. 1–3. The similarity lies in the orientation of perimeter framework members, namely legs point inward toward the center of the framework. This requires that legs be miter cut at all corners: 4 cuts per channel/16 cuts per support tray. There are often more channel type support trays used per machine than angle types-due to machines being larger. The number of miter cuts for channel type support trays is then often more than double that of angle types. For example a 3 deck machine with 6 support trays per deck requires 288 miter cuts. In addition channel type support trays are typically wider and therefore use more end notched support bars. For the example above with 7 support bars per support tray 252 notch outs have to be removed for end notched support bars 32.

Operation of a Side View of Two Prior Art Adjacent Channel Type Support Trays (FIG. 4)

In operation, the support tray composite beam shown in FIG. 4 is loaded greatest at the center area shown by an imposed bending moment. The critical center area midway between the sides of these two adjacent support trays is shown in broken away section. The composite beam is basically formed by end mitered cross channels 24U and 24D. Also to be included as part of the composite beam are seal strip supports 30—though their purpose in design is for wire cloth edge support.

The basic profile shown in section is an "I" beam type profile—an excellent choice for resisting the bending moment. However the considerations with regard to flow and abrasive wear preclude this from being an excellent choice in composite beam design for the chosen application. The profile of the composite beam thus formed resists aggregate flow by a pathway blockage. This profile can be better understood if one considers the path of particles being sorted. Typically particles making their way through wire cloth 26 follow a parabolic trajectory, descending from higher left to lower right. From a particle's viewpoint a line drawn from the upstream facing lower leg of end mitered cross channel 24U to the furthest downstream edge of seal strip 28 represents a blocked zone, that a particle hits.

The lower leg of upstream end mitered cross channel 24U catches and retains aggregate particles 22 further reducing efficiency. FIG. 4 shows leading edges on both legs of the upstream pointing legs of end mitered cross channel 24 worn away by abrasion from aggregate particles. Each support tray of this design has an upstream (against the aggregate "FLOW" vector) pointed end mitered cross channel 24U whose legs are vulnerable to the continuous stream of aggregate particles. The continuous flow of aggregate particles wears away at the upper and lower legs of end mitered cross channel 24U, removing material that resists the compressive and tensile forces of the bending moment. Eventually these fiber "slabs" in the critical area must fail prematurely and/or the design must accommodate the losses by "oversizing" end mitered cross channels 24 initially. Some manufacturers have provided plates to protect the lower channel leg of the end mitered cross channel 24U from abrasion to offset part of this problem. Other methods include cutting away most of the lower leg of cross channel 24U eliminating some resistance to flow, essentially forming an "angle and channel" composite beam. Regardless of the embodiment prior art support trays employing cross channels as perimeter framework members are clearly not optimal in design.

It should be noted that in the prior art for larger wire cloth sizes no seal strip supports 30 or seal strips 28 are used. Greater stresses are typically present with heavier gauge wire cloth. It would make sense to employ seal strip supports 30 if they would contribute significantly to resist these stresses. But as with angle type support trays these items are designed to support wire cloth edges. The wear pattern for channel type support trays without seal strip supports 30 extends across the tops of both end mitered cross channels, thus more than that shown in FIG. 4.

It should be known that many variations of the typical prior art support trays shown here and not shown here exist including:

- the use of tubular members for perimeter framework members
- the use of various fastening methods joining support trays
- the lack of any fasteners joining support trays to each other
- the use of tubes/bars/channels/angles as internal cross supports
- the lack of any internal cross support members
- the lack of any support bars 32
- the lack of seal strip supports 30
- the use of polyurethane decking with various types of supporting structural members attached to the top surface of a prior art support tray
- combinations/variations of the above It should also be noted that design variations of support tray frameworks employed with "continuous support bars"

or "continuous support channels" that span the length of all support tray frameworks of a single deck are known in the prior art. Such a design is a blending of both multiple-pieced deck framework and single piece deck framework designs.

Figure 5:
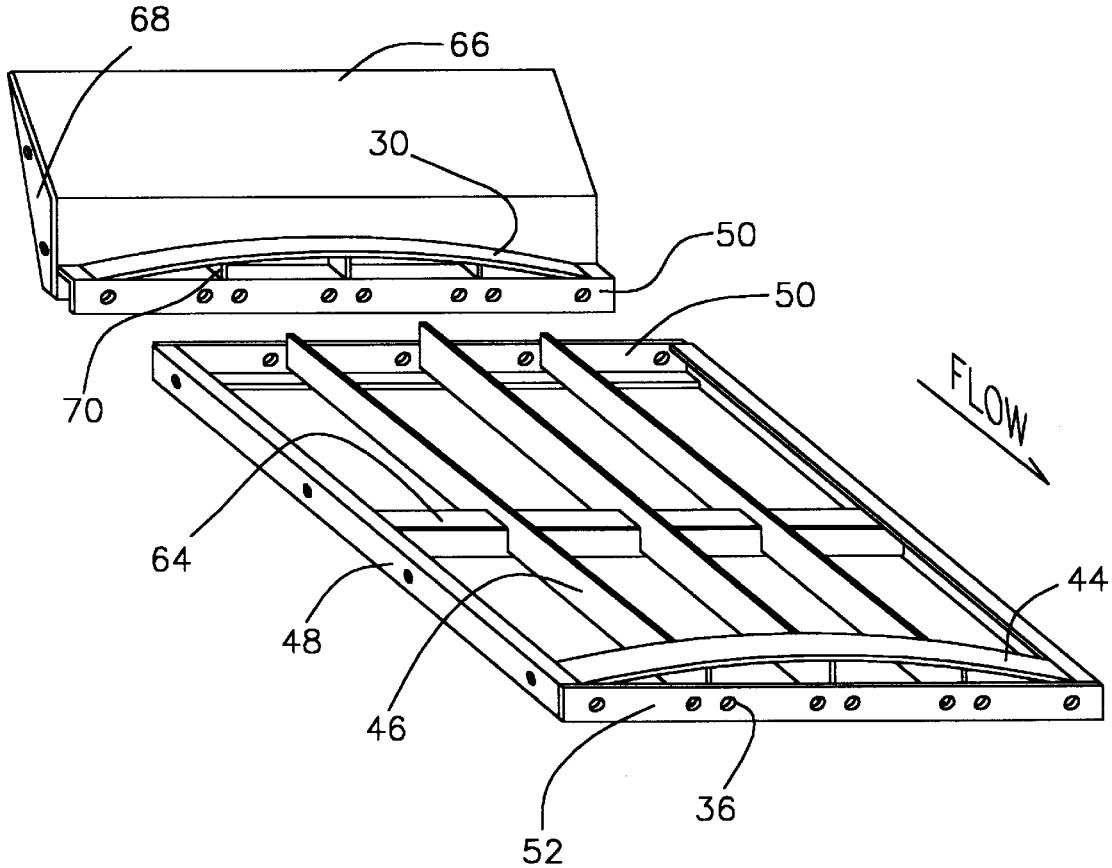
FIG. 5 is an oblique view of two exploded away components: 1) a single improved support tray framework unit of my present invention—shown nearest the observer, and 2) a modified back plate to which this improved support tray framework unit joins-shown furthest from the observer.

FIG. 5—Description of Improved Support Tray System/ Operation of Improved Support Tray System Description of Improved Support Tray System (FIG. 5)

Shown in FIG. 5 is my present invention. The components shown in FIG. 5 are typically metal employing welded unit construction but can also be constructed of other materials such as plastics, composites, fiberglass structural shapes, etc. The embodiment shown in FIG. 5 is one of several preferred embodiments. A general direction of aggregate flow over the surface of wire cloth (not shown in FIG. 5) is established in FIG. 5 by the "FLOW" vector shown. FIG. 5 shows one complete support tray framework of my present invention as well as a "modified" back plate assembly. The back plate assembly shown in FIG. 5 is also shown "exploded away" from the feed end of the support tray to which it mounts when it is installed in an operating position. Shown in FIG. 5 is a modified back plate assembly having: an end plate 66, two end plate sides 68, a square cut cross-angle 50, a seal strip support 30, and three support stubs 70. Items 66, 68, 50, 30, and 70 are typically metal and joined by welding. Square cut cross-angle 50 has fastener holes 36 to facilitate assembly to square cut cross-angles 50 of a support tray shown in FIG. 5. End plate sides 68 have fastener holes 36 to facilitate assembly to vibrating screen side-walls (not shown in FIG. 5). Vibrating screen side-walls have fastener holes to allow for assembly of support trays, modified back plate assemblies, and other components not shown in FIG. 5.

The main difference between the back plate assembly shown in FIG. 5 and those typically found in the prior art is the addition of items 30, 70, and 50. In the prior art a typical back plate assembly has essentially three components: a formed end plate 66 and two end plate sides 68. In FIG. 5, a seal strip support 30, three support stubs 70, and one square cut cross-angle 50 are added to compensate for an offset in the mounting position of the wire cloth. Typical prior art practice is to mount wire cloth in sections that cover over an individual support tray. Thus as was seen in FIGS. 2, 3 and 4 both support trays and wire cloth share the same end seam alignment. My improved support tray design shown in FIG. 5 uses typical wire cloth as used in the prior art. The wire cloth used in the embodiment shown in FIG. 5 will have typical dimensions, but the seams for the wire cloth will not be in alignment with support tray seams. The seams of the wire cloth that are used with this support tray design are essentially centered on wide seal strip support bar 44. Each section of wire cloth starts at the midpoint of seal strip support 44 on the previous support tray and ends on the support tray, which it mostly covers. Such an orientation of seams requires a "starter support" for the edge of wire cloth adjacent to the back plate-hence the "modified" back plate assembly. All wire cloth seams are shifted in this manner further toward the feed end of a vibrating screen deck than the support tray seams. The amount of shift is typically one-half the width of seal strip support bar 44.

This is not the only method of compensating for the offsetting of seams. Another method is to make a "unique" (located feed-most in a deck) support tray that has included at its feed end a second seal strip support. This feed-most support tray would be typically greater in length than other support trays by ½ the width of wide seal strip 44 (or typically the width of seal strip support 30 in the prior art). Having the benefit of uniformity in all support trays in a deck or a vibrating screen is possibly more desirable than having unique "feed-most" support trays. Still other means to accommodate this requirement of offset seams exist, such as a unique "feed-most" ("starter") piece of wire cloth. This is a unique requirement when compared to the prior art, which does not require such an offset adjustment. There are peripheral benefits of this modified back plate assembly such as an increase in strength or stiffness for the assembly itself, yet these typically aren't great improvements. In context this "compensation requirement" proves to be trivial and is easily offset by other advantages, especially concerning the manufacturing and operational benefits of my improved support tray invention.

A complete support tray framework unit of my invention is shown in FIG. 5. Wire cloth, rubber channel and wide/ narrow seal strips are not shown in FIG. 5 to better show my support tray invention. The support tray shown in FIG. 5 is welded (or bonded) at all areas or joints where members contact each other. In FIG. 5 a support tray perimeter framework of this particular embodiment has: one square cut cross-angle 50, two square cut side angles 48 and one square cut flat stock 52. The orientation of the perimeter framework cross/end members is such that square cut cross-angle 50 must be located at the feed end of the support tray for proper performance. Square cut cross-angle 50 must have one leg pointed essentially upward toward the top of a vibrating screen and one leg pointed essentially toward the discharge end of a vibrating screen for proper performance. Square cut flat stock 52 must be located at the discharge end of the support tray for proper performance. Square cut flat stock 52 should be oriented with its longest edges facing the top and bottom of the support tray for best performance. This can be seen in FIG. 5.

Square cut flat stock 52 is to be chosen of a desirable thickness and also can be chosen of abrasion resistant metal to increase both strength and longevity. Abrasion resistant metal flats/sheets are readily available in various thicknesses and hardness/strength values. Two square cut side framework members are shown as square cut side angles 48 in FIG. 5 but can also be channel or some other suitable structural member. Item numbers 48, 50, and 52 all have fastener holes 36 to facilitate assembly of vibrating screens. The seam between two adjacent support trays is formed essentially between square cut flat stock 52 and square cut cross-angle 50. Both square cut flat stock 52 and square cut cross-angle 50 are probably best joined by fasteners located relatively close to (flanking) either side of plain end support bars 46. This would be to better provide rigidity and continuity of the composite beam/truss formed by the two adjacent support tray end framework members. The term composite beam is used extensively to describe the joint area formed by two adjacent support trays in the prior art. In my improved version of a support tray I have also used the term "truss" as the design and performance is also like a truss in some embodiments as will be seen further in this text and the drawing figures.

Square cut cross-angle 50 does not have miter cut ends. Square cut flat stock 52 does not have miter cut ends. Square cut side angles 48 do not have miter cut ends. A cross tube support 64 is shown in this embodiment oriented perpendicular to and joined with square cut side angles 48, and parallel to both square cut cross-angle 50 and square cut flat stock 52. Plain end support bars 46 are shown perpendicular to and joined with square cut cross-angle 50 and square cut flat stock 52, and parallel to square cut side angles 48. Plain end support bars 46 are oriented to maintain an arched support for wire cloth 24 that has its high point in the center of the support tray and its low points near the sides of the support tray. Plain end support bars 46 shown in FIG. 5 each have a notch out for cross tube support 64. Plain end support bars 46 do not have angle leg notch outs as were shown in prior art Figs. and text.

In FIG. 5, a cross tube support 64 is shown being employed as a load bearing element as might be encountered in a typical embodiment. It must be stressed that support 64 is not an essential element in all applications, nor is it always required to have an internal support member. In some "shorter" support trays no crosswise mounted internal support member is used. In such an embodiment plain end support bars 46 have no cut outs and transfer directly all loading to the composite beam/truss at support tray seams.

The principal members receiving the load from plain end support bars 46 are thus square cut cross-angle 50, square cut flat stock 52 and wide seal strip support bar 44. Often with "symmetrical" prior art support tray perimeter frameworks the element determining directional placement in the vibrating screen is an internal support member, not the perimeter framework itself. However, as can be determined from FIG. 5, my support tray invention is directionally placed in a vibrating screen with particular regard to the perimeter framework.

Important to the operation of my support tray invention shown in FIG. 5 is the orientation of the support tray perimeter framework itself as well as the placement/orientation of perimeter components. This orientation enables the performance of this support tray system with regard to flow, abrasion resistance/protection and strength. This is to be contrasted with the prior art perimeter frameworks, which are typically symmetric about support tray seams-directionally insensitive. Thus prior art support trays are often directionally reversible, without need to regard particular feed or discharge ends. As can be seen in FIG. 5 square cut cross-angle 50 should be located at the feed-most end of my improved support tray. Item 50 should also be oriented in the manner shown, with one leg essentially pointed upward and one leg essentially pointed toward the discharge end of my improved support tray. Square cut flat stock 52 should be oriented in the manner shown in FIG. 5 located at the discharge end of the support tray shown. Flat stock 52 should also be oriented as having its long edges essentially parallel to the horizon, with the largest surface areas essentially perpendicular to the general "FLOW" vector. Wide seal strip support bar 44 should be oriented in the manner shown in FIG. 5 located at the discharge end of the support tray shown. Wide support bar 44 should also be essentially adjacent to square cut flat stock 52 near its ends. Wide support bar 44 should contact plain end support bars 46 at their top edges typically in an arcuate manner. A further condition that is required for proper performance is the attachment of adjacent perimeter framework members to each other. This joining can be accomplished by various fastening means-but typically by welding for metal structures.

The corners of the perimeter framework shown in FIG. 5 are of interest in contrast with the prior art. The prior art in typical applications such as that shown in prior art FIG. 1 requires a butt-welded joint with a flat ground top surface of a miter cut corner. This requirement is eliminated for my support tray invention shown in FIG. 5. All welds for the corners shown in FIG. 5 can be welded inside the perimeter framework corner joint. The corner joint at the feed end of each support tray which is formed by square cut cross-angle 50 and square cut side angle 48 has three basic corner fillet welds. In the installed position these would appear as an overhead-horizontal corner fillet, a vertical corner fillet, and a horizontal-flat corner fillet. The outside of the feed end support tray corner does not have to be welded when these welds are made of sufficient strength, typically when the fillet weld size is not less than the thinnest member joined. However the types of materials used must be considered in specifying weld sizes—e.g., if alloys or abrasion resistant metals are used.

The corner design shown at the feed end of the support tray shown in FIG. 5 has the added advantage of a type of "interlocking" of the essentially horizontal oriented angle legs of items cross-angle 50 and side angle 48. Thus the vertically oriented weld joint is strengthened by the leg of side angle 48 with an overhead oriented weld—which acts as an upper gusset. In the same manner the vertically oriented weld joint is also strengthened by the leg of item 50 with an essentially horizontal oriented weld—which also acts as a lower gusset.

Often in the prior art the butt-welded miter cut portion of the corners have required gusset plates to prevent joint fracture. This is due in part to the inherent weakness of butt-welds used with thick metals at this critical area. These butt-welds at the miter cuts on the perimeter framework members at the corners are highly stressed. To overcome this flaw members are gapped some distance apart with gusset plates underneath which span across and reinforce the butt-welds. The embodiment shown in FIG. 5 has no such weld and thus does not require gussets for this purpose. Gussets may be required for corner reinforcement in larger embodiments of FIG. 5, but not for butt-weld reinforcement. The design in FIG. 5 is such that fillet welds are easier to control than butt-welds which require edge distance spacing and/or beveling in addition to miter cutting.

The joint at the discharge end of the support tray shown in FIG. 5 has two basic welds-both corner fillets. The corner joint at the discharge end of the support tray in FIG. 5 is formed by square cut flat stock 52 and square cut side angle 48. The welds of the discharge-oriented corners again need only to be welded on the inside of the support tray framework corner. Thus the outside of the support tray corner shown in FIG. 5 at the discharge end also needs no welding or grinding. Essentially the inside welds would appear as an overhead corner fillet and a vertical corner fillet. At this discharge corner the vertically oriented weld joint is strengthened by the essentially horizontal oriented leg of side angle 48. This welded leg of side angle 48 also acts as a gusset to strengthen the discharge end corner joint.

Shown also is a wide seal strip support bar 44 at the discharge end of the support tray in FIG. 5. Wide seal strip support bar 44 is essentially oriented perpendicular to and joins with square cut side angles 48 at its ends. Wide support bar 44 ends terminate and butt against both opposed-inward facing angle legs of square cut side angles 48. Such a design inherently accommodates the desirable condition of a "gradual blending" of top surfaces of both wide seal strip support bar 44 and square cut side angles 48. It is important to note that the ends of wide support bar 44 can be "shifted" up or down for an offset joint position. This can be used to adjust the termination of the arc used for wire cloth (not shown in FIG. 5) support. Welds to join wide support bar 44 to side angles 48 are most significant on the underside of the joint. Since wide support bar 44 is curved, a slight "V" for welding is inherently present at the joint. This joint design can be further improved with a gap, and/or offsetting of members to each other when desirable.

In the embodiment shown in FIG. 5 wide seal strip support bar 44 is approximately twice as wide as seal strip support 30 previously shown in prior art FIGS. 1, 2 and 4.

Wide seal strip support bar 44, shown in FIG. 5, can be chosen of desirable thickness—probably greater than typical seal strip supports presently employed in the prior art. Wide seal strip support bar 44 has an arcuate profile formed by contacting and being joined to the top edges of plain end support bars 46. Wide seal strip support bar 44 (like square cut flat stock 52) can be made of abrasion resistant metal for increased strength and wear resistance. The curvature of wide seal strip support bar 44 is slight enough so as to accommodate such forming-even with abrasion resistant metal. Abrasion resistant metal is available in flat sheets or bars in various thicknesses and hardness grades allowing suitable selection for wide seal strip support bar 44 and square cut flat stock 52.

Not shown in FIG. 5 are optional "wider" stub supports which would both contact and join to both wide seal strip support bar 44 and square cut flat stock 52. "Wider" stub supports would be used as needed to obtain support between square cut flat stock 52 and wide seal strip support bar 44. This would be somewhat similar to support stubs 70 in FIG. 5, except larger/wider to fit wide support bar 44. Support stubs 70 in FIG. 5 give support to seal strip 30 to provide support and provide curvature for the "feed-most" wire cloth edge. These support stubs are used in the prior art to give support to seal strip support bars in the open area midway between support bars. The use of "wider" stub supports in the embodiments similar to FIG. 5 would be twofold: a) to provide stability for the curvature of wide support bar 44, and, b) to provide strength for the composite beam/truss formed at-the framework joint. This will be further discussed in FIG. 6A.

Operation of Improved Support Tray System (FIG. 5)

Loading of support tray components shown in FIG. 5 is essentially from gravity acting on, and the inertia of, the support tray components in motion themselves as well as the impact loading of aggregate particles (not shown in FIG. 5) being sorted. Other loads imposed by machine side-walls (not shown in FIG. 5) and/or other vibrating screen components may be present during operation as well, but are not of primary concern here. Aggregate particles essentially load wire cloth (not shown in FIG. 5) which in turn essentially loads plain end support bars 46 (through rubber channel-also not shown in FIG. 5). Plain end support bars 46 in turn essentially load cross tube support 64 and end framework angle 50 and flat stock 52, with wide support bar 44. These members (bar 46, angle 50, flat stock 52, and bar 44) then load side angles 48, which load side-walls (not shown in FIG. 5).

Plain end support bars 46 transfer loading to end framework members and also provide a physical link between flat stock 52 and wide support bar 44 similar to the braces of a truss. Angle 50, flat stock 52, bar 44, and bar 46 (as a truss brace) thus essentially become a composite beam or truss at seams/joints between support trays. In addition, if "wider" stub supports are used, a greater continuity is obtained for the truss formed at the joint of two adjacent support trays. This would provide still greater load bearing capability and can be employed on an as needed basis.

Figure 6A:
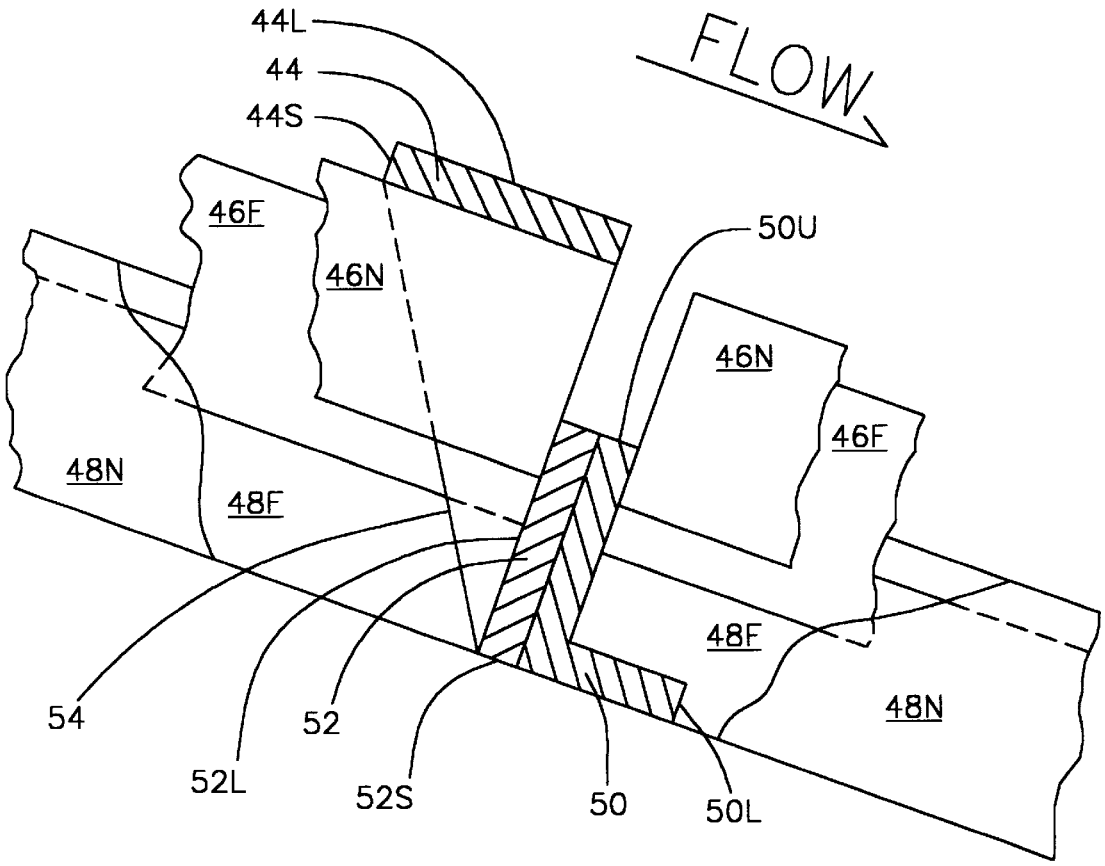
FIGS. 6A and 6B are my present invention and each Fig. shows a partial side view of two adjacent improved support trays, shown in an installed position and joined, having angular side framework members with an angular (feed) end framework member and with a flat stock (discharge) end framework member, both end framework members shown by partial broken section.

The operation of the critical stress area of the end framework members angle 50, flat stock 52 and bar 44 is discussed more particularly in the "operation" section of FIG. 6A. This composite beam/truss is shown in a partial side view with a broken away section at or near the midpoint in FIG. 6A.

The advantages of my support tray invention shown in FIG. 5 are clear in contrast with a typical prior art support tray such as that which is shown in prior art FIG. 1. The support tray shown in FIG. 5:

needs no miter cuts on any perimeter framework members 48, 50 and 52 needs no end notch outs on support bars 46 has more easily fabricated corner welds has better protection/less abrasive wear in critical stress areas has better aggregate flow/less restrictions to flow has a stronger configuration/better strength to weight ratio FIG. 6A—Description of Partial Side View With One Wide Seal Strip Support Bar/Operation of Partial Side View With One Wide Seal Strip Support Bar Description of Partial Side View With One Wide Seal Strip Support Bar (FIG. 6A)

Shown in FIG. 6A is a partial side view of the seam area between two adjacent support trays of essentially the same embodiment as shown in FIG. 5. The view is also partially broken away to reveal the cross section of the seam area midway between near side angle 48N and far side angle 48F. The general direction of aggregate flow over the surface of support trays and wire cloth (wire cloth is not shown in FIG. 6A) is indicated by the "FLOW" vector in FIG. 6A. Support trays shown in FIG. 6A are shown in an installed, inclined position. Shown partially in FIG. 6A are two adjacent support trays—the discharge end of an "upstream" oriented support tray fastened to a "downstream" oriented feed end of an adjacent support tray. The discharge end of the upstream support tray is partially shown with near side angle 48N and support bars near—46N and far—46F broken away on the left side of FIG. 6A. Flat stock 52 and wide seal strip support bar 44 are shown in cross section also as part of the upstream support tray. In similar fashion the downstream support tray shown on the right side of FIG. 6A has near side angle 48N and support bars near—46N and far—46F broken with angle 50 shown in cross section. The seam between adjacent support trays shown, is essentially formed by square cut flat stock 52 and square cut cross-angle 50. Not shown in FIG. 5 but present in FIG. 6A is a supporting gusset 54. This is located in the discharge end of the upstream (left) support tray midway between near support bar 46N and far support bar 46F, and is triangular in shape. Supporting gusset 54 is essentially a "wider" stub support as mentioned previously in text pertaining to FIG. 5.

As is shown in FIG. 6A wide seal strip support bar 44 is oriented such that wide seal strip support bar short side 44S is oriented essentially perpendicular to the FLOW vector shown in 6A. Thus wide seal strip support bar long side 44L is oriented essentially parallel with the general flow of aggregate over the surface of wire cloth (not shown in FIG. 6A). It is also illustrated in FIG. 6A that square cut cross angle 50 is oriented such that square cut cross angle upper leg 50U is essentially perpendicular to the FLOW vector, and square cut cross angle lower leg 50L is essentially parallel to aggregate flow. Also evident in FIG. 6A is the orientation of square cut flat stock 52. Square cut flat stock 52 is oriented such that square cut flat stock short side 52S is oriented essentially parallel with the FLOW vector in 6A. Thus square cut flat stock long side 52L is oriented essentially perpendicular to the FLOW vector in 6A. In embodiments similar to FIG. 6A of the present support tray invention, the orientation of wide seal strip support bar 44, square cut cross angle 50, and square cut flat stock 52 are oriented similar to FIG. 6A.

Angle 50 and flat stock 52 are fastened typically by mechanical fasteners such as bolts, rivets, studs, etc. It may not be necessary to fasten angle 50 to flat stock 52 in all embodiments, but improved stability and strength are obtained by fastening. The means for fastening is not shown in FIG. 6A, but holes are present in angle 50 and flat stock 52 in a pattern similar to that shown in FIG. 5. Different hole patterns are suitable for a variety of embodiments similar to FIG. 5 employing fasteners. It should be noted that any sufficient fastening means that allows angle 52 and flat stock 50 to be secured together with minimal movement between members under load will work.

As mentioned previously in this application in text describing FIG. 5, optional bracing between plain end support bars 46 can be employed as needed. This is shown in FIG. 6A as supporting gusset 54. The factors that determine such a need are in part:

- the width of the vibrating screen
- the type of material being sorted
- the type of material comprising the support tray framework
- the desired "crown height" of wide bar 44
- the spacing of support bars 46
- the desired motion of vibrating screen
- the cross sectional dimensions of flat stock 52, angle 50 and wide seal strip support 44.

Such bracing as gusset 54 can also take the form of flat rectangular "wider stub supports" or short pieces of angle, tube, etc.

Operation of Partial Side View With One Wide Seal Strip Support Bar FIG. 6A

Shown in cross section in FIG. 6A are wide seal strip support bar 44, flat stock 52 and angle 50, which essentially form a composite beam/truss at joints between adjacent support trays. Square cut flat stock 52 is joined to square cut cross-angle 50 by some suitable fastening means causing both items to act in unison. Wide seal strip support bar 44 also acts in unison with items 52 and 50 as a contributing support element for the truss. This happens by connections via plain end support bars 46, supporting gusset 54 and square cut side angles 48. As material being sorted passes over the surface of the wire cloth (not shown in FIGS. 5 or 6A) it loads plain end support bars 46 which load any internal support members (FIG. 5) and the truss formed by wide bar 44, flat stock 52, and angle 50. Roughly the profile of a "Z" can be seen by those elements shown in FIG. 6A in cross section. This cross sectional is shown at/near the center between side angles 48N and 48F. This is typically at the area of greatest stress for this beam/truss. Such loading basically puts compression loading o n the upper portions of this "Z" and tensile loading on the lower portions.

Wide support bar 44 is essentially in compression at the area where it is shown in cross section in FIG. 6A. Wide support bar 44 is connected at its ends to square cut side angle 48 and square cut flat stock 52 at the corer joint of the feed oriented (left) support tray at its discharge end. Essentially this provides support at the ends of wide support bar 44 preventing movement outward or inward. In tension in FIG. 6A then are the bottom portions of square cut flat stock 52 and square cut cross-angle 50. The greatest tensile load of the truss is typically carried mostly by the lower discharge painting leg of square cut cross-angle 50. This is due to both the cross sectional surface area shown in FIG. 6A and the location of the lower discharge pointing leg. Obviously the load is also supported in part by the lower portions of square cut flat stock 52, but to a lesser extent. The general loading is such that the top "fiber slab" of the "Z" is in compression and the bottom "fiber slab" is in tension.

The composite beam formed by angle 50, flat stock 52 and wide support bar 44 is essentially uniformly loaded transverse to its longitudinal axis. This bending moment stress develops a maximum essentially at the midpoint of the composite beam. This improved support tray design carries the loads imposed in a much better manner than prior art designs by capitalizing on the need for an arcuate top surface profile of deck frameworks. This necessary profile has its high crown in the center of the deck between vibrating screen side-walls. Such a crown is necessary to maintain the proper flow distribution of aggregate particles over the wire cloth or porous media covering a deck framework. The high point or crown is at center between the side-walls where, coincidentally, the maximum stresses of the bending moment occur. This necessary arcuate profile is taken advantage of in my support tray invention in a manner comparable to bridge trusses. Bridge trusses often employ an arcuate top profile whose top framework is a member designed to resist the bending moment stresses in compression. The flat bottom portion of such a truss is designed to resist the bending moment stresses in tension. The top and bottom "fiber slabs" of bridge trusses are "linked" by braces that connect both of these members to maintain the continuity and integrity of the truss. I use the terms truss and composite beam to identify the beam formed by adjacent (end) cross framework members. In some respects the joined framework members can be described by both terms.

In the support tray shown in FIG. 6A, plain end support bars 46 and supporting gussets 54 are the braces that connect/link the top and bottom "fiber slabs". Plain end support bars 46 and supporting gussets 54 also provide axial stability to the composite beam's longitudinal axis. This axial stability is desirable and increases load-bearing capacity of the composite beam at the seam between adjacent support trays. This stability is provided principally by plain end support bars 46 which also load wide support bar 44, flat stock 52, and angle 50 directly.

As mentioned earlier in text supporting FIG. 1, the most efficient manner of resisting the bending moment is to create a beam that in general has two relatively equal, connected fiber slabs parallel and as far apart as possible, such as an "I" beam. The neutral axis in such bending moment beam applications is located (for areas at or near the beam's center) midway between the fiber slabs. Here the composite beam introduced is more of a "Z" profile than an "I" profile. The neutral axis in this "Z" composite beam/truss is also located near midway between the two principal fiber slabs. The actual location of the neutral axis depends upon many factors such as the thickness of the members chosen and the material types employed. For example, if a thick abrasion resistant plate is chosen for wide seal strip support bar 44, then support bar 44 is much stronger and thus influences the position of the neutral axis. In contrast, the prior art support trays such as shown in FIGS. 1, 2, and 3 show principal fiber slabs in a much weaker position with regard to both the neutral axis and each other. The "I" beam in the classic case has both upper and lower fiber slabs centered on the web portion of the beam. The embodiment shown in FIG. 6A has fiber slabs, which are offset in the "Z" profile. Such an offset resists loading well and is also ideal for flow and wear properties.

Wide seal strip support bar 44 is covered by a rubber seal strip and then by wire cloth (not shown in FIG. 6A). These two items provide some protection for support bar 44, shielding it from erosion. Support bar 44 in turn shields flat stock 52 and cross-angle 50 from particles being sorted. Support bar 44 and flat stock 52 can be made of abrasion resistant material providing further strength and longevity for the joint.

The flow of particles being sorted follows in general a parabolic pathway as particles move from higher left to lower right in FIG. 6A. The particles that fall through the wire cloth thus move in an arcuate path. The general direction of this path is aligned somewhat with the hidden (dotted) line of gusset 54. Thus, a line parallel with the hidden line of gusset 54 but drawn from the downstream edge of wide support bar 44 to angle 50 would show the pathway on the downstream side of the joint. These two essentially parallel lines-the hidden line of gusset 54 and the line drawn from the downstream edge of wide support bar 44 to the downstream edge of angle 50—together show the blocked pathway. This is a "blind" area, spanning the width of the support trays where the framework members at the joint prevent free passage to lower deck areas. In comparison with the prior art—such as in FIGS. 2 and 3—this area of blockage is appreciably smaller in embodiments of my improved support trays. The dimensions of wide support bar 44, flat stock 52 and angle 50 all determine the exact dimensions of the blocked area. Some of the factors, which that determine the pathway of the material being sorted, are:

the angle/slope of an inclined vibrating screen the angle/slope of the driving motion for horizontal type vibrating screens the magnitude of the throw/stroke material being sorted the screening media employed.

It is important to note that the embodiments shown here are able to perform well in multiple-slope deck screens, as well as differential angle deck screens. In differential angle deck screens support trays would each be inclined to the horizontal position at different angles. Put differently, the support trays are inclined to each other, i.e. they don't share the same plane of operation. This type of application is probably best employed with the embodiment shown in FIG. 6B.

Figure 6B:
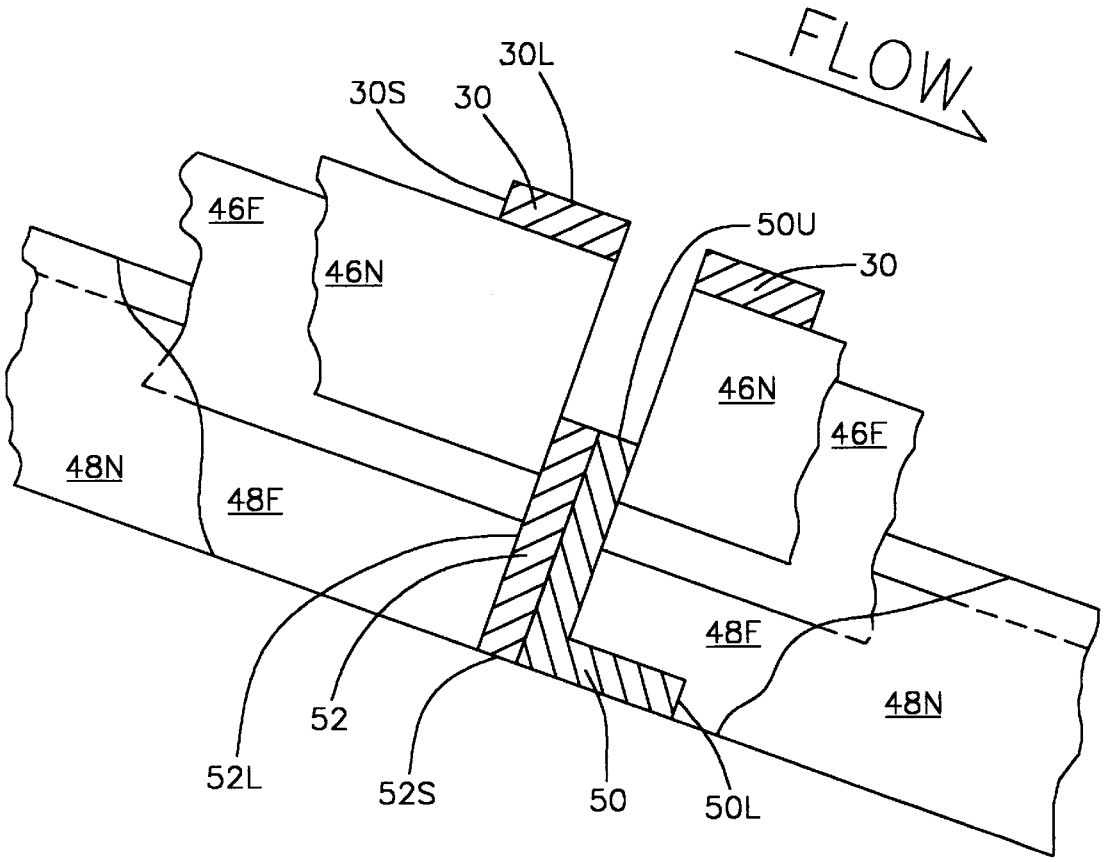

FIG. 6B—Description of Partial Side View With Two Seal Strip Support Bars/Operation of Partial Side View With Two Seal Strip Support Bars Description of Partial Side View With Two Seal Strip Support Bars (FIG. 6B)

Shown in FIG. 6B is a partial side view of two adjacent support trays similar to FIG. 6A except two seal strip supports are used instead of one. The "FLOW" vector indicates the general direction of aggregate flow over support trays and the surface of wire cloth (wire cloth is not shown in FIG. 6B). Shown in FIG. 6B are two seal strip supports 30 instead of one wide seal strip support bar 44. Thus each support tray of the type shown in FIG. 6B has two seal strip supports 30—one at the feed end/one at the discharge end. The embodiment in FIG. 6B is otherwise identical to that shown in FIG. 6A.

As is shown in FIG. 6B seal strip support 30 is oriented such that seal strip support short side 30S is oriented essentially perpendicular to the FLOW vector shown in 6B. Thus seal strip support long side 30L is oriented essentially parallel with the general flow of aggregate over the surface of wire cloth (not shown in FIG. 6B). It is also illustrated in FIG. 6B that square cut cross angle 50 is oriented such that square cut cross angle upper leg 50U is essentially perpendicular to the FLOW vector in 6B and square cut cross angle lower leg 50L is essentially parallel to aggregate flow. Also evident in FIG. 6B is the orientation of square cut flat stock 52. Square cut flat stock 52 is oriented such that square cut flat stock short side 52S is oriented essentially parallel with the FLOW vector in 6B. Thus square cut flat stock long side 52L is oriented essentially perpendicular to the FLOW vector in 6B. In embodiments similar to FIG. 6B of the present support tray invention, the orientation of seal strip support 30, square cut cross angle 50, and square cut flat stock 52 are oriented similar to FIG. 6B.

The embodiment shown in FIG. 6B shows both support trays "in plane" to each other. This embodiment can also be used in differential angle deck applications. In such applications the seams between support trays are not perpendicular to side framework members. At least one end (or both ends) of square cut side angle 48 would be attached at an angle other then 90 degrees to square cut flat stock 52 or (and) square cut cross-angle 50. This provides the "tilt" between support trays that is inherent to differential angle decks. This tilting can be accomplished by cutting side angle 48 at the angle that flat stock 52 or cross-angle 50 require for proper mounting. This type of cutting on side angle 48 is not shown in FIG. 6B. This is also accomplished by having a pie-shaped gap at the juncture between side angle 48 and flat stock 52/cross-angle 50 and filling it with weld. When this method is used side angle 48 is cut perpendicular (as shown in FIG. 6B) to its longitudinal axis. This latter method is best used when both flat stock 52 and cross-angle 50 are tilted to side angle 48. In this method if an angle change of 15 degrees between support trays is required then each member is tilted away 7.5 degrees usually at the bottom portion of side angle 48. It is important to note that neither of these methods/embodiments is illustrated in any of the drawings in this application. The embodiment shown in FIG. 6B adapts easily to differential angle deck arrangements.

Operation of Partial Side View With Two Seal Strip Support Bars (FIG. 6B)

The support trays shown in FIG. 6B perform similar to those in FIG. 6A with some differences regarding flow and wear. The composite beam has two separate fiber slabs at the upper portion of the composite beam/truss, seal strip supports 30. The composite beam/truss at the joint then becomes half an "I" beam and half a "Z" beam. The top portion of the beam is essentially a "T" in cross section. The bottom portion is essentially an "L" in cross section. The cross sectional area is substantially the same as in FIG. 6A, so in strength is comparable to the embodiment shown in FIG. 6A. Having the upper fiber slabs divided into two parts is arguably somewhat weaker, but having the upper slabs more centered is arguably somewhat stronger. Thus, substantially the performance between embodiments is similar with regard to load bearing at the seam area. Abrasion protection and flow is somewhat different between embodiments 6A and 6B.

As can be seen from FIG. 6B, protection from particles being sorted is different than that of FIG. 6A. In this embodiment (FIG. 6B) wire cloth edges cover a seal strip that spans and covers over both seal strip supports 30, wire cloth and seal strip are not shown in FIG. 6B. This arrangement acts as a "shield" similar to wide support bar 44 in FIG. 6A, only this arrangement is shifted toward the discharge end. In general the protection in this embodiment is lessened for flat stock 52 the higher the overall cross sectional height becomes. This is true especially for the critical center area of the composite beam/truss. Here flat stock 52 can be made of abrasion resistant steel. It is important to note that the leading (upper) edge of flat stock 52 is protected from particles. Lower portions of the upstream pointing face of flat stock 52 are exposed to particles, but at a slight angle of deflection. The ends of flat stock 52 have better protection as seal strip support 30 is lower (curves downward) at this area, shielding even lower portions of flat stock 52.

In some embodiments having a lower cross sectional profile, the ends of cross-angle 50 may also find better protection in this embodiment as seal strip support 30 covers over these ends more directly. The gap between adjacent seal strip supports 30 can be adjusted to be smaller if desired, if thicker members are used for flat stock 52 and/or angle 50. This is done by notching the corners at the ends of supports 30, which allows supports 30 to move over the vertical portions of flat stock 52 and angle 50. This of course can be done in any of the embodiments shown in this application though it isn't shown in any of the drawings.

Flow in general is slightly more restricted in this embodiment as compared with FIG. 6A. This is true in general for the scale of embodiments used in these illustrations. In embodiments of 6B having profiles of lesser height flow my actually be improved over 6A. It is also important to note that though seal strips 30 are shown to be of essentially identical width, a support tray can have different widths for feed and discharge seal strip supports.

Figure 7A:
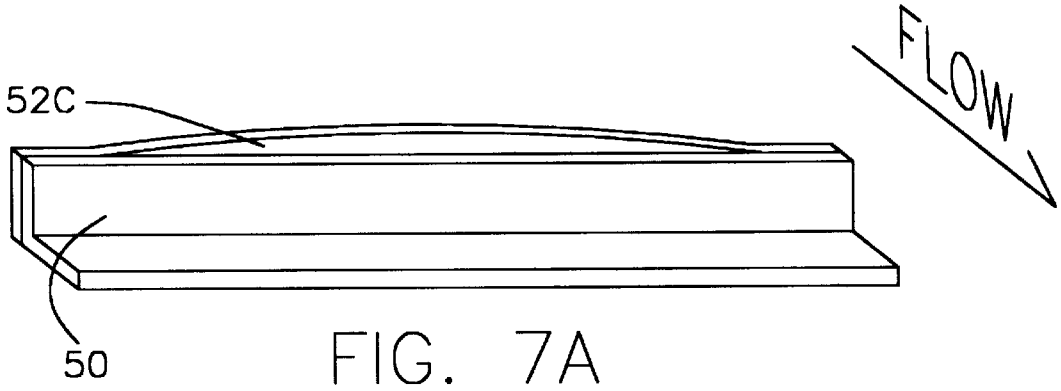
FIG. 7A is an oblique view of two end framework members of an embodiment of my improved support tray invention, positioned as if improved support trays were joined, and shows an angular (feed) end framework member, and a curved top flat stock (discharge) end framework member which form the joint/seam area between my improved support trays.

FIG. 7A—Description of Two Adjacent End Framework Members/Operation of Two Adjacent End Framework Members Description of Two Adjacent End Framework Members (FIG. 7A)

Two adjacent end framework members are shown in FIG. 7A without any fastener holes or fasteners. The "FLOW" vector is shown in FIG. 7A indicating the general direction of flow of aggregate particles over support trays when operating. Only two items are shown in FIG. 7A—curved top flat stock 52C and square cut cross-angle 50. As shown in FIGS. 7A (also 7B and 7C) curved top flat stock 52C is a discharge end framework member. Consequently square cut cross-angle 50 is a feed end framework member of my support tray design. In this embodiment of my support tray, one curved top flat stock 52C and one cross-angle 50 are used per support tray. These two end framework members are shown adjacent to each other in an assembled position forming the seam between support trays of this embodiment.

Curved top flat stock 52C (FIGS. 7A–7C) is comparable to square cut flat stock 52 (FIGS. 5, 6A, and 6B) as both are substantially flat planar sheets. The composition of curved top 52C can be any variety of metals or composite materials or Fiberglas etc. Again, since this is not a formed structural shape (such as angle or channel) it is easily fabricated of any of the suitable abrasion resistant metals when desired for longer life and/or greater strength. The main difference between curved top 52C and flat stock 52 is the curved top edge of curved top 52C. Fastener hole locations and placement of other components for a support tray having end framework members shown in FIG. 7A is similar to FIG. 5.

Though it is not shown in FIG. 7A, square cut cross-angle 50 can also have a curved top portion that essentially follows curved top flat stock 52C. This can be either a modified structural angle (i.e. a structural angle having an arcuate cut) or a flat sheet similar to curved top 52C, but having a greater height, which is bent/folded to become an angle.

Operation of Two Adjacent End Framework Members (FIG. 7A)

Figure 7B:
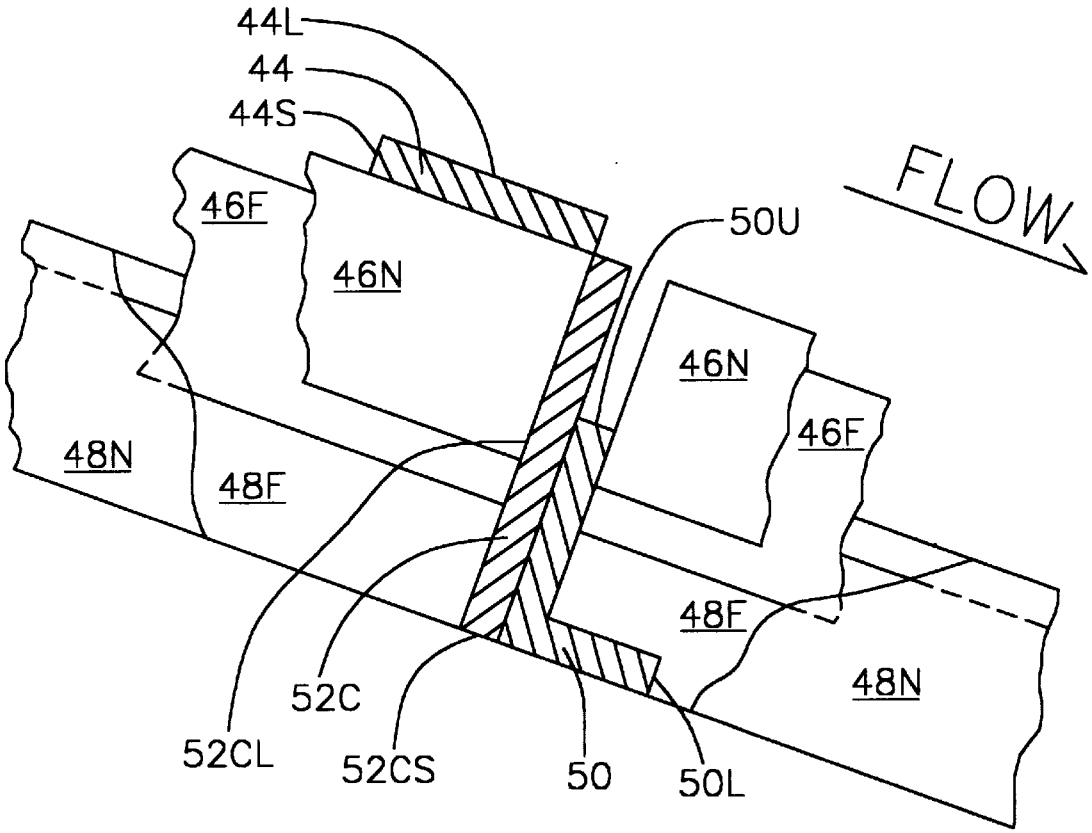
FIGS. 7B and 7C are my present invention and both Figs. show a partial side view of two adjacent improved support trays, shown in an installed position and joined, each support tray has two angular side framework members with an angular (feed) end framework member and with a curved top flat stock (discharge) end framework member, both end framework members are shown by partial broken section.
Figure 7C:
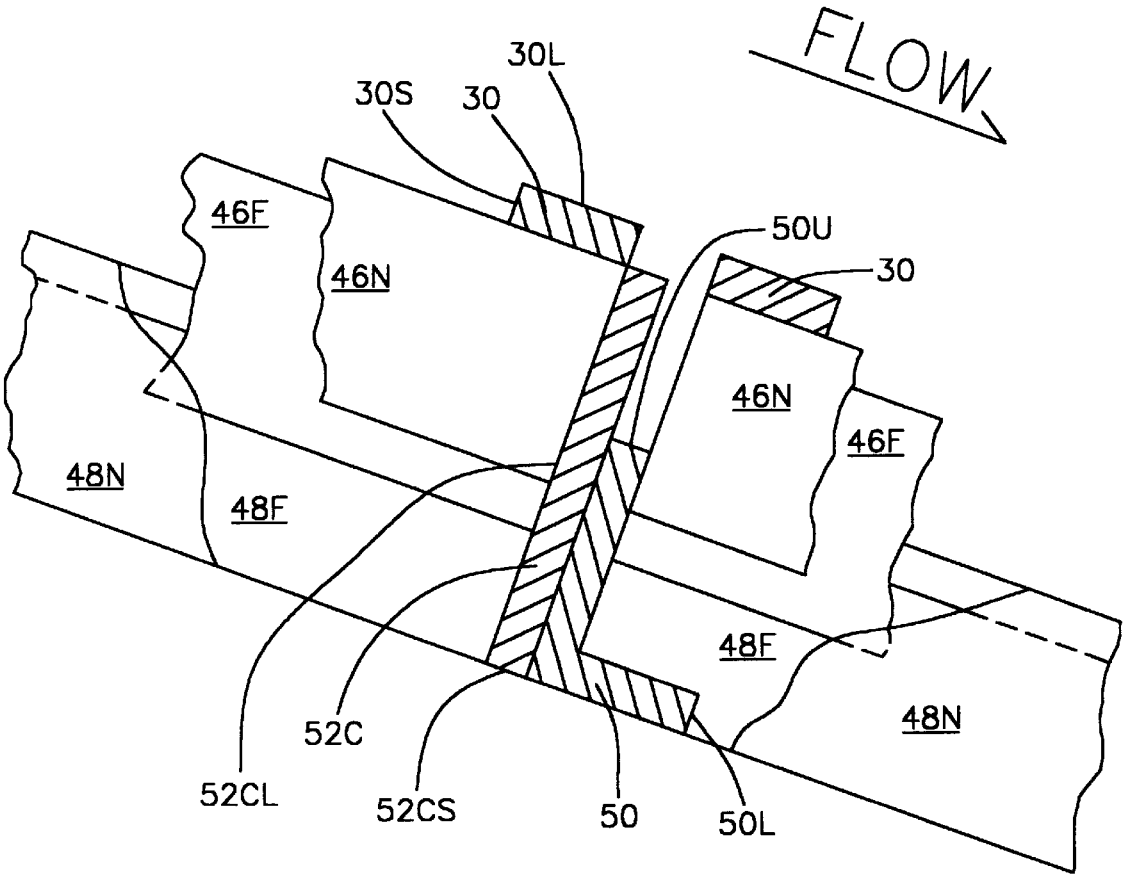

Curved top 52C and angle 50 are shown in a position as would be oriented in a joint area between adjacent support trays. This embodiment shown in FIG. 7A has inherent operational advantages even greater than embodiments having flat stock 52. Curved top 52C has a curved top edge portion extending beyond angle 50 at the center portion of the span. Having the top edge of item 52C curved increases the load carrying capacity of the center of the beam where bending moment stresses are greatest. This is accomplished in two ways. First, the cross sectional area at midpoint of the composite beam has additional upper fibers (in curved top 52C) to resist stresses imposed. Second, the continuity between any seal strip support used (narrow or wide) is increased, thereby increasing the load carrying capability of the uppermost (seal strip support) fiber slab. It is necessary to have at least intermittent bonding between curved top 52C and a seal strip support for this second benefit to occur. Such a bonding in the embodiments employing metal construction would typically be intermittent or continuous welds along adjacent edges. FIGS. 7B and 7C both employ curved top flat stock 52C as an end framework member.

FIGS. 7B AND 7C,—Description of Partial Side Views With Curved Top Flat Stock/Operation of Partial Side Views With Curved Top Flat Stock Description of Partial Side Views With Curved Top Flat Stock (FIGS. 7B and 7C,)

Description FIG. 7B:

Shown in FIG. 7B is a partial side view of two adjacent support trays of my invention. The area at the center of the span between support tray sides is shown in broken section. A vector marked "FLOW" indicating the general flow of aggregate over support trays is shown in 7B. Construction of support trays shown is similar to those shown in FIGS. 5 and 6A except for curved top 52C is used in place of flat stock 52. A composite beam is formed by: support 44, curved top 52C and angle 50; which are shown in cross section in FIG. 7B. In this embodiment, curved top 52C is attached to both support bar 46 and support 44 typically by welding. Curved top 52C and support 44 are chosen of a desirable thickness and can be made of abrasion resistant material to provide strength and durability for a given application. Curved top 52C and angle 50 form the seam between adjacent support trays. In this embodiment as in FIG. 6A wire cloth (not shown in FIG. 7B) seams are offset from support tray seams. Also shown in FIG. 7B are side angles 48 and support bars 46.

Description FIG. 7C:

Shown in FIG. 7C is a partial side view of the joint between two adjacent support trays of my invention. The composite beam/truss formed by adjacent end framework members is shown in partial broken section, broken away at or near the portion midway between support tray sides. Construction is like that shown and mentioned in text concerning FIG. 6B except for curved top 52C is used in place of flat stock 52. The "FLOW" vector shows a general direction of aggregate flow over the surface of wire cloth/screening media (not shown in FIGS. 6B or 7C). Curved top 52C, angle 50 and two supports 30 are shown in cross section and essentially form the basic composite beam/truss formed by adjacent end framework members. Curved top 52C is shown as a discharge end framework member of an upstream oriented support tray. Angle 50 is shown as a feed end framework member of an adjacent downstream oriented support tray. A scam between adjacent support trays is formed at the interface between curved top 52C and angle 50. Two seal strip supports 30 are employed per support tray oriented symmetrically about support tray seams. FIG. 6B shows a similar orientation of supports 30. Curved top 52C is attached to both items 46 and 24A. For improved strength support 30 (at discharge end of support trays) should be intermittently welded/bonded to curved top 52C to maintain structural integrity of the composite beam. Such an attachment of support 30 is similar to that of support 44 in FIG. 7B. Supports 30 and curved top 52C can be adjusted in thickness and chosen of abrasion resistant material for strength and durability.

It should be noted that no fasteners joining adjacent support trays are shown in FIGS. 7A–7C. It should be further noted that no welds, bonding methods, wire cloth, rubber channel, rubber seal strip, or aggregate particles are shown in FIGS. 7A–7C.

Operation of Partial Side Views With Curved Top Flat Stock (FIGS. 7B and 7C)

Operation FIG. 7B:

FIG. 7B reveals a composite beam at the joint of two adjacent identical support trays. The composite beam members shown in the partial broken section are support 44, curved top 52C and angle 50. Curved top 52C is joined to support 44 and acts as a "gusset" like the web of an "I" beam. Curved top 52C thus connects the upper and lower fiber slabs in concert with angle 50. This embodiment is especially strong as it has both upper and lower fiber slabs separated by a substantial distance and their peak separation is at the ideal location—the area of greatest stress. The continuity of the composite beam is excellent when curved top 52C and support 44 are joined effectively by intermittent or continuous welding. It is desirable to fasten curved top 52C and angle 50 to maintain the continuity of the composite beam. When items support 44 and curved top 52C are chosen of a heavier thickness and of abrasion resistant material the strength and durability is increased further. Resistance to wear is also excellent in this embodiment.

Support 44 together with wire cloth and rubber seal strip (neither shown in FIG. 7B) act as a shield for the composite beam—protecting curved top 52C, angle 50 and any exposed mechanical fasteners. Protection varies with the dimensions of the elements of the support tray, material types and its application. In general this is a design having excellent strength, flow, abrasion protection and durability when compared to the prior art.

Operation FIG. 7C:

The embodiment shown in FIG. 7C is similar in operation to FIG. 6B, but stronger still. Having curved top 52C as a discharge end framework member gives the composite beam formed at the joint both greater continuity and more "upper fiber material". Greater continuity between support 30 and the composite beam allows support 30 to contribute more to resist the bending moment. The added upper portion of curved top 52C above angle 50 further adds to strength, as these fibers are generally in areas away from the neutral axis.

Regarding flow and abrasion resistance performance is essentially the same for 7C as for 6B. The upper portions of curved top 52C may in some higher profile embodiments shield angle 50 more than if flat stock 52 (FIG. 6B) were used.

As with the embodiment shown in FIG. 6B this embodiment is an excellent choice for applications where differential angle decks are desirable. Performance of this embodiment exceeds that of 6B in comparable cases and therefore is even further advantageous over the prior art than 6B.

Figure 8A:
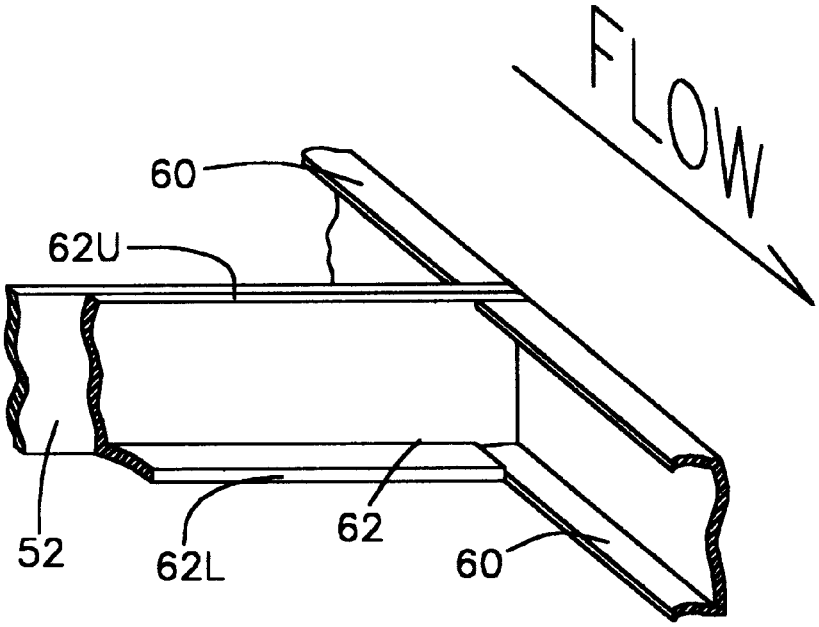
FIGS. 8A and 8B are my present invention and each Fig. shows a partial oblique view in the corner areas of two adjacent improved support trays, shown in an installed position and joined, each one having an angular (feed) end framework member with a flat stock (discharge) end framework member and employing channel type side framework members.
Figure 8B:
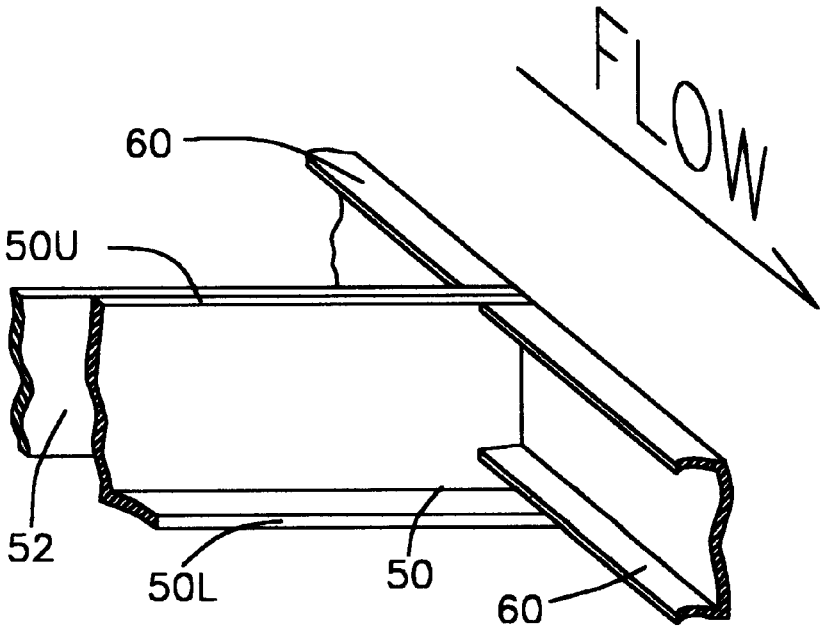

FIGS. 8A AND 8B—Description of Improved Support Tray Framework With Side Channels/Operation of Improved Support Tray Framework With Side Channels Description of Improved Support Tray Framework With Side Channels (FIGS. 8A and 8B)

Description FIG. 8A:

FIG. 8A illustrates an embodiment of my improved support tray system, which has channels as side framework members. Shown in partial oblique view are the corner portions of two adjacent improved support trays of my invention. The "FLOW" vector shown in FIG. 8A indicates the general direction of flow of aggregate particles over support trays when operating. The "FLOW" vector indicates that the observer in FIG. 8A is viewing the adjoining structures from essentially a discharge position looking toward a feed position, albeit at an angular perspective. No fasteners/fastener holes are shown, nor is any other portion of the support trays shown, just the perimeter framework members at the corners. Side channels 60 in FIG. 8A can replace side angles 48 in any of the embodiments of my improved support tray system when needed.

Square cut flat stock 52 is shown attached to square cut side channel 60 at a discharge end of support trays of the type shown in FIG. 8A. A notched end angle 62 is shown as a feed end cross framework member attached to side channel 60. Notched end angle upper leg 62U is shown to be essentially perpendicular to the FLOW vector in FIG. 8A. Thus notched end angle lower leg 62L is shown to be essentially parallel with the FLOW vector in FIG. 8A. The embodiment shown has the heights of side channel 60 equal with notched end angle 62. Thus a conflict occurs at the bottom of the corner where legs of angle 62 and side channel 60 meet. This is resolved in FIG. 8A with the notched out portion of angle 62 at its lower discharge pointing leg. Other options are to miter both members of square cut side channel 60. The embodiment shown in FIG. 8B illustrates an alternate design, which eliminates the need for notching/mitering.

Description FIG. 8B:

Shown in FIG. 8B is an embodiment of my support tray invention similar to FIG. 8A except that square cut cross-angle 50 replaces notched end angle 62. The height of cross-angle 50 is greater than end angle 62, being extended/displaced to the lower area below the bottom plane of the support tray established by flat stock 52 and side channel 60. This eliminates the need for notching or mitering cross-angle 50/side channel 60. The "FLOW" vector shown in FIG. 8B indicates the general direction of flow of aggregate particles over support trays when operating.

The embodiments in FIGS. 8B and 8A are typically metal and welded at all joints. A single support tray of the type shown in FIG. 8B has a perimeter framework of two opposed side channels 60, a cross-angle 50 at the feed end, and a flat stock 52 at the discharge end. Square cut cross-angle upper leg 52U is shown oriented essentially perpendicular to the FLOW vector shown in FIG. 8B. Thus square cut cross-angle lower leg 52L is shown oriented essentially perpendicular to the FLOW vector. This embodiment in FIG. 8B can be used whenever side channels 60 are desirable with any of the previously mentioned/illustrated embodiments of my invention. Typically the applications for these embodiments are for heavier duty applications. Thus the scale/dimensions of the members used is typically larger than embodiments of my improved support tray system having angular side framework members.

Operation of Improved Support Tray Framework With Side Channels (FIGS. 8A and 8B)

Operation FIG. 8A:

The composite beam formed by flat stock 52 and end angle 62 essentially loads side channels 60 in FIG. 8A. The stress imposed is principally shear stress at the corner joint formed by end angle 62 and side channel 60. Likewise at the corner joint where flat stock 52 meets side channel 60, shear stresses are principally present. The center portions of the composite beam formed by flat stock 52 and end angle 50 is loaded in the form of a bending moment.

Regarding the bending moment for the embodiment shown in FIG. 8A the dimensions of the members are often greater when compared to angular embodiments. This takes the form of higher structural distances between top and bottom portions of support trays for perimeter framework members in general. The applications for these embodiments are typically for larger machines in general having greater widths for support trays. Thus the bending moment is of concern with greater lengths of transversely loaded structural members used for the composite beam. The composite beam shown in FIG. 8A generally has greater cross sectional height, thus affording it greater strength.

The perimeter framework members (and thus composite beam) are chosen of dimensions to accommodate the loads imposed. Where seal strip supports are used, greater strength is also obtained, as this is a stressed member in my improved support tray system. Thus for larger screens having heavier duty/wider body applications, FIG. 8A of my improved support tray system is very strong and works well with various screening media.

Concerning the corner joint where end angle 62 meets side channel 60 shear stresses load the essentially vertical portions of the joint. This portion of the corner joint is joined in a manner similar to the prior art-fillet welding inside, and possibly outside corner fillet welds for any offset edges. The notched portion of end angle 62 is typically thicker and thus higher than the tapered leg of side channel 60 to which it joins. This height difference provides a good joint for welding legs together. This joint can also be mitered, but this is less desirable, for reasons discussed concerning the prior art. Side channel 60 can also be notched and in some embodiments this may be preferred. In some heavier applications, gussets are employed at corners for strength, though none are shown in any of the drawing Figs. of this application.

Operation FIG. 8B:

The performance of the embodiment shown in FIG. 8B is similar to that shown in FIG. 8A except square cut cross-angle 50 provides greater strength for the composite beam. Cross-angle 50 provides greater strength for comparable structural sizes as it is greater in height and therefore resists the bending moment still further. The added benefit of eliminating the interference of angle and channel legs such as in FIG. 8A makes this more desirable still. This does require space for the projection of cross-angle 50 below the bottom planar surface established by the other support tray framework members.

In some embodiments it may be desirable to have this greater strength, but also to have the ends of cross-angle 50 mounted flush with side channels 60 as in FIG. 8A. Another alternative is to have the lower leg of cross-angle 50 mounted above the lower leg of side channel 60, i.e. essentially the opposite of FIG. 8B. In either of these cases it is possible to have cross-angle 50 modified to meet these requirements. This can be done by having the center portion of cross-angle 50 lower than the bottom planar portion of the support tray, but the end portions either curve or angle upward to be flush with or above the lower leg of side channel 60. A variety of ways to accomplish this are known.

An example of such an angular member would be similar to the left-hand (discharge end) portion of the composite beam shown in FIG. 7B. Wide seal strip support bar 44 is attached to curved top flat stock 52C forming the shape of just such a member. To better grasp the orientation shown in FIG. 7B for such an angular (feed end) framework member, imagine rotating support 44 and curved top 52C 180 degrees, as it were a single member, about its longitudinal axis. The two members for this purpose are joined together and thus act as a single member. Thus an angular member having a curved drop in its center portion and ends which have discharge pointing legs higher in elevation than center areas is obtained. This is an example of a two piece/built-up angular member, but other means of obtaining the same result are available.

Angles can be rolled or formed having a dip at center, then the vertical leg can be left curved. Otherwise oversize pieces can be used initially and the curved portion/arc of the vertical leg cut off, if a straight/flat top is desired. Other means are to have a "V" shaped angular member, angling upward toward side channels, either built up or formed. Forming would be possible with a (roughly) five-sided sheet having a "V" shaped notch out at lower center. Such a notch out would allow leg portions of the member to be bent essentially 90 degrees to the same side, thus closing the "V" notch out at center where lower discharge pointing legs can be welded together if desired.

FIGS. 9, 10, 11, and 12—Description of Several Oblique Views of Several Embodiments of Improved Support Tray Invention Description of Several Oblique Views of Several Embodiments of Improved Support Tray Invention (FIGS. 9, 10, 11, & 12):

FIG. 9

Figure 9:
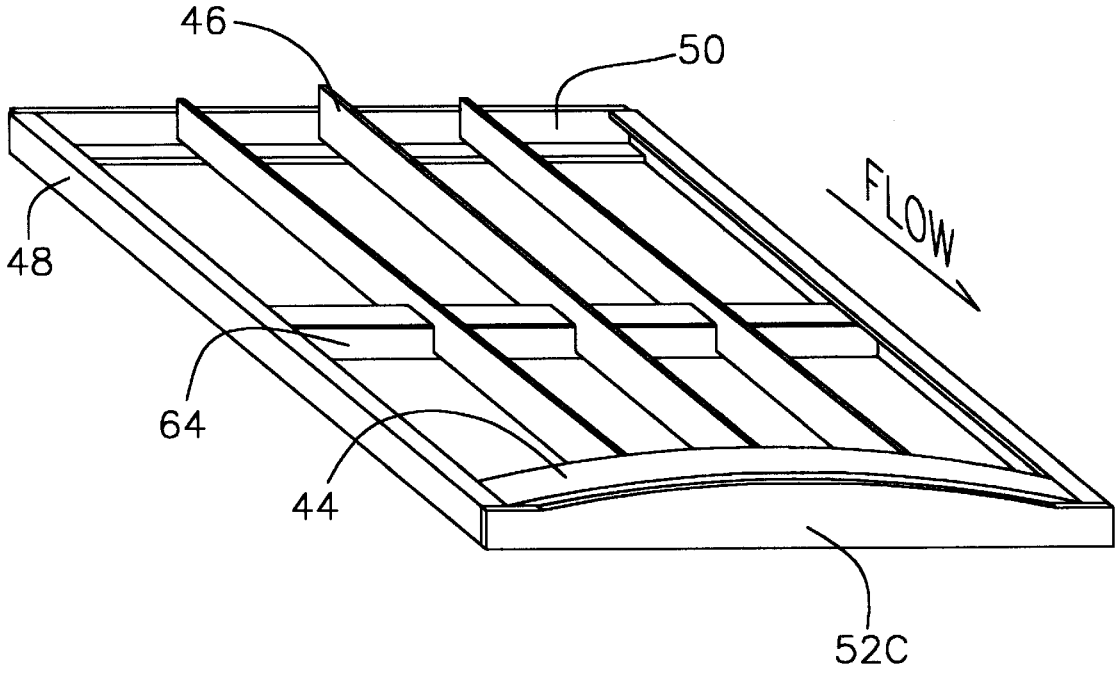

FIG. 9 shows an oblique view of an embodiment of the present invention of the type shown in cross section in FIG. 7B. The support tray shown has square cut side angles 48 similar to those also illustrated in FIG. 5. Square cut side angles 48, curved top flat stock 52C, and square cut cross-angle 50 essentially form the perimeter framework of the support tray shown in FIG. 9. No fasteners or fastener holes are shown in FIG. 9. A "FLOW" vector in FIG. 9 indicates the general flow of aggregate over the support tray shown.

FIG. 10

Figure 10:
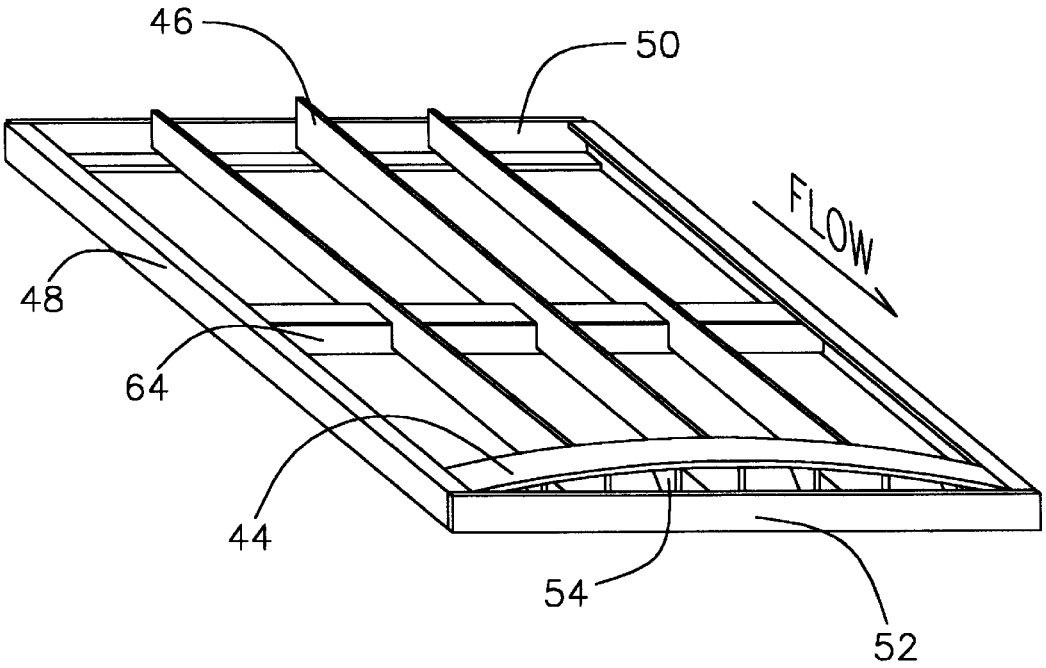

FIG. 10 shows an oblique view of an embodiment of the present invention of the type shown in cross section in FIG. 6A. The support tray shown has square cut side angles 48 similar to those also illustrated in FIG. 5. Square cut side angles 48, square cut cross-angle 50, and square cut flat stock 52 essentially form the perimeter framework in FIG. 10. No fasteners or fastener holes are shown in FIG. 10. A "FLOW" vector in FIG. 10 indicates the general flow of aggregate over the support tray shown.

FIG. 11

Figure 11:
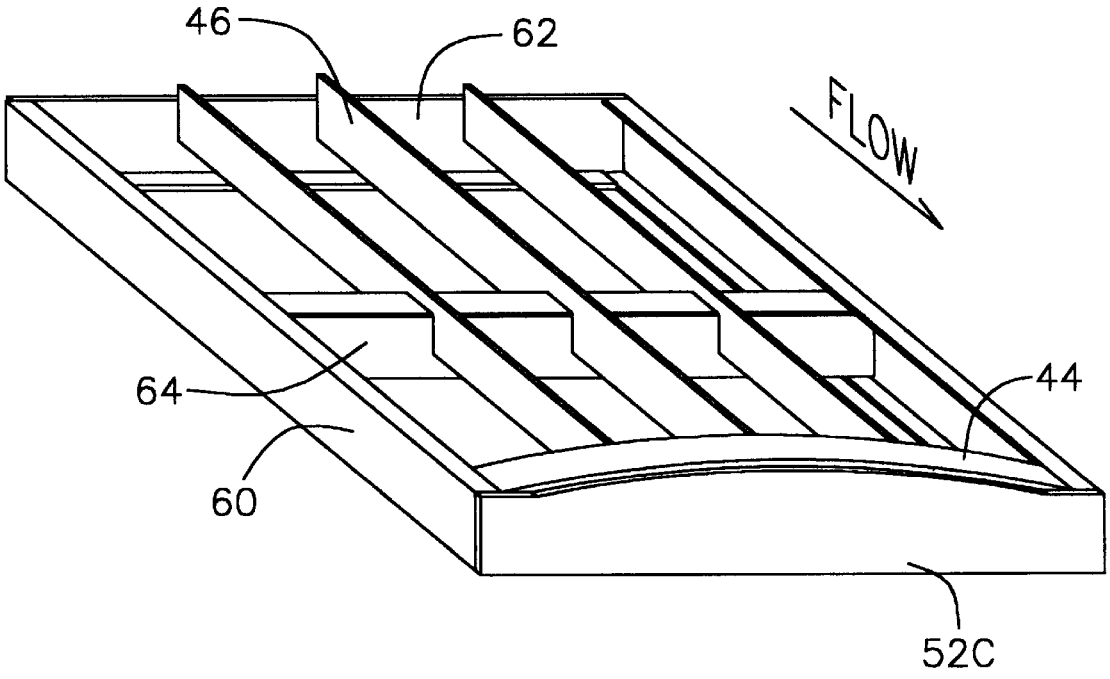

FIG. 11 shows an oblique view of an embodiment of the present invention of the type shown in cross section in FIG. 7B. However in FIG. 11 square cut side channels 60, similar to those illustrated in FIG. 8A are used, not square cut side angles 48. Square cut side channels 60, curved top flat stock 52C, and notched end angle 62, essentially form the perimeter framework in FIG. 11. No fasteners or fastener holes are shown in FIG. 11. A "FLOW" vector in FIG. 11 indicates the general flow of aggregate over the support tray shown.

FIG. 12

Figure 12:
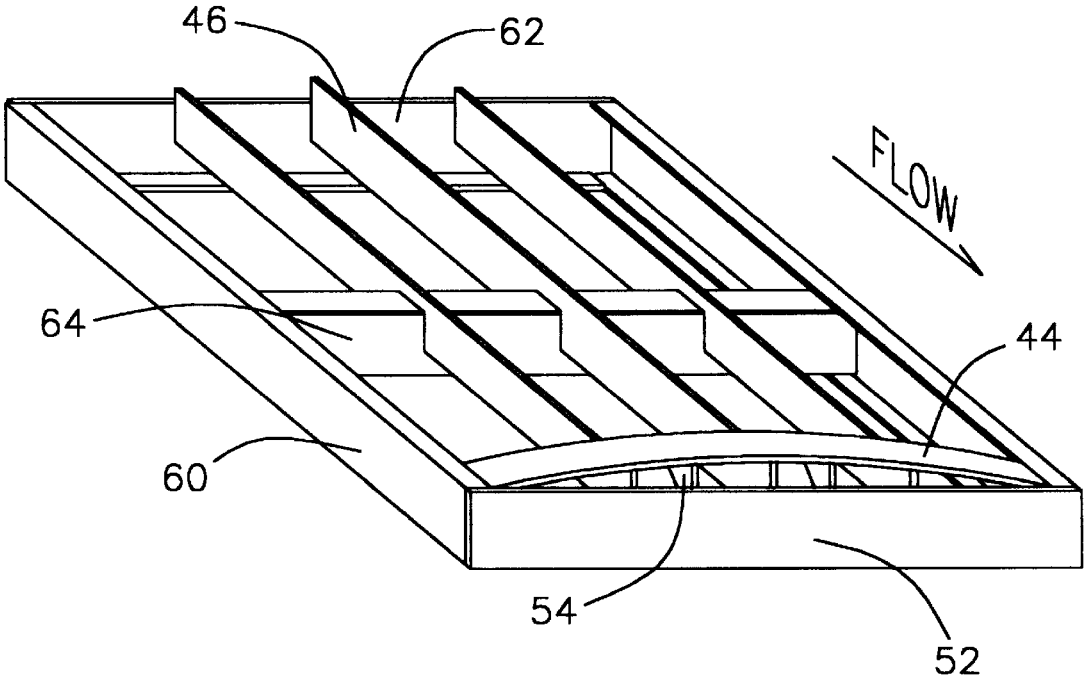

FIG. 12 shows an oblique view of an embodiment of the present invention of the type shown in cross section in FIG. 6A. However in FIG. 12 square cut side channels 60, similar to those illustrated in FIG. 8A are used, not square cut side angles 48. No fasteners or fastener holes are shown in FIG. 12. Square cut side channels 60, square cut flat stock 52, and notched end angle 62, essentially form the perimeter framework in FIG. 11. A "FLOW" vector in FIG. 12 indicates the general flow of aggregate over the support tray shown.

SUMMARY, RAMIFICATIONS, AND SCOPE

Accordingly the reader will see that the improved support tray framework embodiments of my invention have many significant advantages over the prior art in both manufacture and operation. Some advantages of my improved vibrating screen deck support framework system over the prior art are:

no miter cuts are needed on perimeter framework members no end notch outs are needed on support bars corner welds are more easily fabricated wear protection is better/wear is less in critical areas aggregate flow is improved overall strength or strength to weight ratio is increased It should be realized that these advantages are comparisons with various prior art embodiments and thus the advantages vary somewhat depending upon the particular embodiments compared. It should be realized that the embodiments shown are not all possible embodiments, just some of the presently preferred embodiments. It should thus further be realized that these advantages listed are not necessarily all of the advantages of my improved support tray deck framework system. Although many specifics concerning the above embodiments have been mentioned in this application, these should not be construed as limiting the scope of this invention.

Many variations in materials, dimensions, locations of holes, spacing of components etc., are included. Some of the variations have been mentioned in text pertaining to drawing FIGS. 5–12. Many other possible embodiments within the scope of this invention occur with changes in framework components to adapt to various screening media types, or vibrating screen body designs. For example, flat stock or other structural shapes can be used for side framework members, the use of no (or different) internal structural members contained within my support tray perimeter frameworks, employing my improved support tray system within vibrating screens having decks which move independent of each other, etc.

Thus the scope of this invention should be determined by the appended claims and their legal equivalents, rather than by the examples given.

I claim:

1. A support tray as a modular unit of a multiple pieced interconnected deck support framework system for use in a vibrating screen which has a feed end to discharge end flow of materials being sorted or conveyed, said support tray having a perimeter framework of predetermined dimensions comprising:

(a) two side framework members being opposed and elongated and of substantially equal length including square cut side angle (48) or square cut side channel (60), having a predetermined cross sectional shape and predetermined dimensions, said two side framework members so oriented to each have a feed end portion and a discharge end portion, and essentially oriented to each have respective longitudinal axes oriented so as to substantially share a common plane and to be essentially parallel to each other and to be essentially parallel with said flow of materials to be sorted in said vibrating screen, and (b) an elongated feed end cross framework member including square cut cross angle (50) or notched end angle (62), having end portions attached to said feed end portions of said two side framework members and having a first longitudinal axis both oriented in a plane essentially perpendicular to said flow of materials and a second longitudinal axis oriented in a plane essentially parallel to said flow of materials, said elongated feed end cross framework member having a cross sectional shape essentially angular in profile thus having two common leg portions oriented such that a square cut cross angle upper leg (50U) or notched end angle upper leg (62U) is oriented to point in an essentially upward direction and also essentially perpendicular to said flow of materials, and a square cut cross angle lower leg (50L) or notched end angle lower leg (62L) is oriented essentially parallel with said flow of materials, and (c) an elongated discharge end cross framework member including square cut flat stock (52) or curved top flat stock (52C) having end portions attached to said discharge end portions of said two side framework members and having a longitudinal axis oriented both in a plane essentially perpendicular to said flow of materials and in a plane essentially parallel with said flow of materials, said elongated discharge end cross framework member having a cross section essentially rectangular in profile, said cross section oriented such that a square cut flat stock short side (52S) or curved top flat stock short side (52CS) are oriented essentially parallel with said flow of materials and a square cut flat stock long side (52L) or curved top flat stock long side (52CL) is oriented essentially perpendicular to said flow of materials, and said support tray further including an elongated at least one plain end support bar (46), each support bar having a longitudinal axis oriented essentially parallel with said flow of materials, having feed end portions attached to said feed end cross framework member including square cut cross angle (50) or notched end angle (62), and having discharge end portions attached to said discharge end cross framework member including square cut flat stock (52) or curved top flat stock (52C), and said support tray further including an elongated curved support member comprising wide seal strip support bar (44) or seal strip support (30) having predetermined dimensions and having two end portions thereof, each end portion of which is attached essentially to each of the two respective discharge end portions of said two side framework members including square cut side angle (48) or square cut side channel (60), said elongated curved support member oriented essentially above and/or essentially adjacent to said elongated plain end support bar (46), said elongated curved support member being also located essentially adjacent to and/or essentially above said elongated discharge end cross framework member including square cut flat stock (52) or curved top flat stock (52C), said elongated curved support member being oriented essentially higher in elevation in central portions thereof than said two end portions, and is thus essentially curved in an arc generally higher at said central portions, said elongated curved support member having an essentially rectangular cross sectional profile, said cross sectional profile oriented such that a seal strip support short side (30S) or a wide seal strip support bar short side (44S) is oriented essentially perpendicular to said flow of materials and seal strip support long side (30L) or a wide seal strip support bar long side (44L) is oriented essentially parallel with said flow of materials, further enabling said elongated curved support member to additionally be used to support edge portions of screening media as needed, and said support tray further including a fastening means for attachment of said two side framework members to vibrating screen side-walls for attaching said support trays to said vibrating screen, and also including a fastening means for attachment of said elongated feed end cross framework member to join with said elongated discharge end cross framework member for attachment of adjacent support trays to each other, whereby a support tray having increased strength, flow, and wear characteristics and can be more easily manufactured and used in service.

2. The support tray of claim 1 wherein the materials used for manufacture are selected from the group consisting of composite materials and fiberglass structural shapes and plastics and ceramic coated materials.

3. The support tray of claim 1 wherein said fastening means for attachment of said two side framework members to vibrating screen side-walls and said fastening means for attachment of said elongated feed end cross framework member to join with said elongated discharge end cross framework member includes mechanical fasteners and fastener holes (36).

4. The support tray of claim 1 additionally including an elongated curved support member including wide seal strip support bar (44) or seal strip support (30), oriented as the elongated curved support member described in claim 21, except the additional elongated curved support member is located essentially adjacent to and/or essentially above said elongated feed end cross framework member, said additional elongated curved support member having two end portions thereof, each end portion of which is attached essentially to each of the two respective feed end portions of said two side framework members, whereby an additional elongated curved support member can be employed.

5. The support tray of claim 1 further including a centrally located cross member or members including cross angle support (42) or cross tube support (64), having a longitudinal axis orientation essentially parallel with and essentially coplanar with said elongated feed end cross framework member and essentially parallel with and essentially coplanar with said elongated discharge end cross framework member, said centrally located cross member or members also located essentially between said elongated feed end cross framework member and said elongated discharge end cross framework member.

6. The support tray of claim 1 wherein the material used for manufacture is principally metal.

7. The support tray of claim 1 wherein the material used for manufacture is abrasion resistant metal.

8. The support tray of claim 6 wherein said fastening means for attachment of said two side framework members to vibrating screen side-walls and/or said fastening means for attachment of an elongated discharge end cross framework member of a first support tray to join with an elongated feed end cross framework member of an adjacent support tray in said deck support framework includes welding.

9. The support tray of claim 6 wherein the method used for manufacture is casting.

* * * * *

UNITED STATES PATENT AND TRADEMARK OFFICE

CERTIFICATE OF CORRECTION

PATENT NO. : 6,019,228
DATED : February 1, 2000
INVENTOR(S) : Duggan, John C.

It is certified that error appears in the above-identified patent and that said Letters Patent is hereby corrected as shown below:

Column 4,
Lines 27 to 29, change: 'Figs. 13 and 14 show partial side views of two sets of adjacent improved support trays, shown in an installed position joined.' to:
- Figs. 13 and 14 are partial side views of the present invention showing embodiments similar to those Figs. 6A, 6B, 7B, and 7C. -

Column 8,
Line 45, change '40D' first occurrence, to – 40U -.

Column 9,
Line 31, change 'half' to – half -.

Column 19,
Line 46, change 'o n' to – on -.
Line 51, change 'corer' to – corner -.

Column 24,
Line 55, change 'scam' to – seam -.

Column 28, after line 61, insert the text:
- FIGURES 13 AND 14 - DESCRIPTION OF TWO PARTIAL SIDE VIEWS OF IMPROVED SUPPORT TRAY INVENTION

Figure 13 shows an embodiment of the present invention similar to Fig. 6A, except wide seal strip support bar 44 is shifted as mentioned previously in the text of Fig. 6B. Fig. 13 is also similar to Fig. 6B in that the protection from aggregate particles is essentially the same.

In a similar manner Fig. 14 shows an embodiment of the present invention similar to Fig. 7B, except wide seal strip support 44 is likewise shifted. Fig. 14 is also similar to Fig. 7C in the shielding of aggregate particles.

Wide seal strip support 44 is preferably attached to the discharge end side framework members and also extends over the seam between support trays. Wide seal strip support 44 can alternately be attached to the feed end of side framework members as is seal strip support 30 shown on the right hand side of the support tray seams in Figs. 6B and 7C. - .

UNITED STATES PATENT AND TRADEMARK OFFICE

CERTIFICATE OF CORRECTION

PATENT NO. : 6,019,228
DATED : February 1, 2000
INVENTOR(S) : Duggan, John C

It is certified that error appears in the above-identified patent and that said Letters Patent is hereby corrected as shown below:

Column 31,
Line 19, change 'additionally including' to –additionally or alternately including-.
Line 22, change 'claim' 21 to –claim 1-.
Line 23, change 'additional elongated' to –additional or alternate elongated-.
Line 25, change 'additional elongated' to additional or alternate elongated-.

Column 32,
Line 1, change 'additional elongated' to –additional or alternate elongated-.
Line 16, change 'claim 1' to –claim 6-.

Signed and Sealed this

Seventh Day of August, 2001

Nicholas P. Godici

*Attest:*

*Attesting Officer*

NICHOLAS P. GODICI
*Acting Director of the United States Patent and Trademark Office*